US008800216B2

(12) United States Patent
Phillips et al.

(10) Patent No.: US 8,800,216 B2
(45) Date of Patent: Aug. 12, 2014

(54) SYSTEM FOR CONNECTING DISSIMILAR COMPONENTS WITH PLASTIC CONNECTORS

(75) Inventors: William J. Phillips, Batavia, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 64 days.

(21) Appl. No.: 13/420,308

(22) Filed: Mar. 14, 2012

(65) Prior Publication Data

US 2012/0227349 A1 Sep. 13, 2012

Related U.S. Application Data

(63) Continuation-in-part of application No. 12/942,679, filed on Nov. 9, 2010, now abandoned.

(51) Int. Cl.
*E04B 1/38* (2006.01)

(52) U.S. Cl.
USPC ..... 52/79.6; 52/36.2; 52/79.5; 52/79.9; 52/588.1; 446/108

(58) Field of Classification Search
USPC ..... 52/36.2, 79.1, 79.5, 79.6, 79.9, 270, 52/588.1; 446/108
See application file for complete search history.

(56) References Cited

U.S. PATENT DOCUMENTS

| | | | | |
|---|---|---|---|---|
| 3,866,381 | A | 2/1975 | Eschbach et al. | |
| 4,021,089 | A * | 5/1977 | Bush | 312/265.5 |
| 4,557,091 | A | 12/1985 | Auer | |
| 5,036,634 | A | 8/1991 | Lessard et al. | |
| D371,208 | S | 6/1996 | De Zen | |
| 6,250,022 | B1 | 6/2001 | Paz et al. | |
| 6,438,902 | B1 * | 8/2002 | Muller | 52/79.1 |
| 6,701,678 | B1 * | 3/2004 | Skov et al. | 52/79.9 |
| 6,821,049 | B1 * | 11/2004 | Greene | 403/352 |
| 6,892,497 | B2 * | 5/2005 | Moon et al. | 52/79.1 |
| 7,293,785 | B2 * | 11/2007 | Bush et al. | 280/47.34 |
| 7,543,411 | B2 * | 6/2009 | Whitehead et al. | 52/66 |
| 7,581,357 | B2 * | 9/2009 | Richardson et al. | 52/79.5 |
| 7,707,783 | B2 * | 5/2010 | Mower et al. | 52/79.1 |
| 7,770,339 | B2 * | 8/2010 | Mower et al. | 52/93.2 |
| 7,877,936 | B2 * | 2/2011 | Uffner et al. | 52/90.1 |
| 7,926,227 | B2 * | 4/2011 | Mower et al. | 52/79.6 |
| 8,069,820 | B2 * | 12/2011 | Anderson et al. | 119/498 |
| 8,091,289 | B2 * | 1/2012 | Mower et al. | 52/79.5 |
| 8,132,372 | B2 * | 3/2012 | Mower et al. | 52/79.1 |

* cited by examiner

*Primary Examiner* — Adriana Figueroa
(74) *Attorney, Agent, or Firm* — McHale & Slavin, P.A.

(57) ABSTRACT

The present invention provides a system or kit of connectors and panels which can be readily assembled to form a structure with the use of a minimal number of tools. Panels are precut so that measurements and cutting of the panel component materials is eliminated. Connectors are provided for attachment to the panels which allow the panels to be assembled to the floor and roof panels without the need for fasteners. The roof and floor structures are formed from interlocking plastic panels. The roof and floor panels include a structure that cooperates with the connectors secured to the wall panels to allow for the construction of a plurality of structures using like constructed connectors. Wall panels may be chosen from a variety of materials which allow a consumer to construct a building such as a storage shed that best suits his/her needs.

26 Claims, 50 Drawing Sheets

48
115

16
50
14
52
48
14
16

24
241
46
117

14
62
64
64
40

62
12
27
26
28
241
110
38
38
38

98

100

102

95
96
94

108

110

112
96

244
246
206

244
246
248

SYSTEM FOR CONNECTING DISSIMILAR COMPONENTS WITH PLASTIC CONNECTORS

CROSS REFERENCE TO RELATED APPLICATION

This application is a continuation-in-part of U.S. application Ser. No. 12/942,679, filed Nov. 9, 2010 now abandoned, and entitled "Combo Wood and Plastic Storage Enclosure", the contents of which are incorporated herein in their entirety.

FIELD OF THE INVENTION

This invention relates generally to connectors for assembling structures from panels; more specifically, the present invention relates to a system of connectors that provide for the assemblage of an enclosure from panels constructed of various materials whereby the material used for the panel may be readily substituted with another material to construct substantially the same enclosure.

BACKGROUND OF THE INVENTION

Utility sheds are a necessity for lawn and garden maintenance, as well as general all-around home storage space. Typically, items such as lawn mowers, garden tillers, snow blowers, wheel barrows, shovels, rakes, brooms and the like consume a great deal of floor space in a garage. This results in the homeowner parking his/her vehicles outside of the garage.

The prior art has proposed a number of different storage buildings or utility sheds assembled from a kit which includes a plurality of blow molded or extruded plastic panels and connectors. These kits are readily assembled by a homeowner to form storage structures or utility sheds of various sizes. These structures are generally suitable for the storage of hand tools and smaller lawn equipment. Typically, these kits require extruded metal or plastic connector members having a specific cross-sectional geometry which facilitates an engagement between the connector members and one or more of the blow molded plastic panels having a complimentary edge configuration. Due to the nature of the manufacturing process, blow molded plastic components cannot be formed with the intricate shapes and/or sharp corners required for integrated connectors. In addition, blow molded plastic components are hollow and cannot be formed with the integral strengthening ribs and gussets that injection molded panels can be formed with.

A particularly common structure for the connector members is the I-beam cross section. The I-beam defines free edge portions of the connector member which fit within approximately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective wall panel, and thereby serve to join such panels together at right angles. Straight or in-line versions of the connector members are also included in the kits to join panels in a coplanar relationship to create walls of varying length.

Extruded components generally require hollow longitudinal conduits for strength. Due to the nature of the manufacturing process, the conduits are difficult to extrude in long sections for structural panels. Thus, the panels require connectors to achieve adequate height for utility shed walls. A common structure for connecting extruded members has a center I-beam with upper and lower protrusions for engaging the conduits. However, wall panels utilizing connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length. The protrusions are situated to slidably engage the conduits located in the side panel sections to create the height required for utility shed walls.

The aforementioned systems can also incorporate roof and floor panels to form a freestanding enclosed structure such as a utility shed. U.S. Pat. Nos. 3,866,381; 5,241,634; and 4,557,091 disclose various systems having inter-fitting panel and connector components. Such prior art systems, while working well, have not met all of the needs of consumers to provide the structural integrity required to construct larger sized structures. Larger structures must perform differently than smaller structures. Larger structures require constant ventilation in order to control moisture within the structure. Large structures must also withstand larger wind and snow loads compared to smaller structures. Paramount to achieving these needs is a panel system which eliminates the need for extruded connectors to create enclosure walls which resist panel separation, buckling, racking, and a roof system which allows ventilation while preventing weather infiltration. A further problem is that the walls formed by the panels must tie into the roof and floor in such a way as to unify the entire structure. Also, from a structural standpoint, the structure should include components capable of withstanding the increased wind, snow and storage loads required by larger structures. From a convenience standpoint, a door must be present which can be readily installed after assembly of the wall and roof components. The door must also be comparable with the sidewalls and provide ready access to the interior of the structure. Also, from a convenience standpoint, the structure should permit natural as well as artificial lighting. The structure should be aesthetically pleasing in appearance to blend in with the surrounding structures.

There are also commercial considerations that must be satisfied by any viable structure assembly system or kit; considerations which are not entirely satisfied by the state of the art products. The structure must be formed from relatively few components which are inexpensive to manufacture by conventional techniques. The enclosure must also be capable of being packaged and shipped in a knock-down state. In addition, the system or kit must be modular and facilitate the creation of a family of enclosures that vary in size but which share common, interchangeable components.

Finally, there are ergonomic needs that an enclosure system must satisfy in order to achieve acceptance by the end user. The system must be easily and quickly assembled using integrally formed connectors requiring minimal hardware and tools. Further, the system must not require excessive strength to assemble or include heavy component parts. Moreover, the system must assemble together in such a way so as not to detract from the internal storage volume of the resulting enclosure, or otherwise detract from the internal storage volume of the resulting enclosure, or otherwise negatively affect the utility of the structure.

SUMMARY OF THE INVENTION

The present invention provides a system or kit of connectors and panels which can be readily assembled to form a structure with the use of a minimal number of tools. Panels are precut so that measurements and cutting of the panel component materials is eliminated. Connectors are provided for attachment to the panels which allow the panels to be assembled to the floor and roof panels without the need for fasteners. The roof and floor structures are formed from interlocking plastic panels. For example, the roof and floor may comprise one or more plastic panels secured together. The roof and floor panels include a structure that cooperates with the connectors secured to the wall panels to allow for the construction of a plurality of structures using like constructed connectors. Wall panels may be chosen from a variety of materials which allow a consumer to construct a building such as a storage shed that best suits his/her needs. For example, the consumer can choose a storage structure size whereby the roof, floor and connectors are provided. The consumer can then choose the material for the walls of the structure from materials such as wood, plastic, cement board, metal or the like. The connectors can then be secured to the panels and thereafter be snapped into position along the pre-assembled floor. The roof may then be snapped into place along the upper surface of the wall panels.

The connectors may be secured to the wall panels using conventional fasteners and simple hand tools. The components have preformed notches and tabs in order to facilitate assembly of the components without the requirement for measurements. This assures that the components will be assembled correctly and eliminates the opportunity for inaccurate measurements and incorrect assembly.

Accordingly, it is an objective of the instant invention to provide a system or kit for assembly of a utility enclosure which utilizes plastic connector components to create structures of varying dimensions by using common components.

It is a further objective of the instant invention to provide wall panels selected from either precut wood or molded plastic that utilize the plastic connectors to provide interchangeability to the panels.

It is a further objective of the instant invention to provide a utility enclosure system or kit which utilizes plastic connector components to secure walls between the roof and floor structures.

It is yet another objective of the instant invention to provide a utility enclosure system or kit which utilizes plastic structural frame and panel members having integrated connectors for creating enclosures of varying sizes.

It is a still further objective of the instant invention to provide a utility enclosure system or kit wherein the panel members utilize connectors which accommodate various panel materials for increased versatility in shed construction.

It is still another objective of the instant invention to provide a utility enclosure system or kit which utilizes structural corner assemblies for increased enclosure rigidity.

It is still another objective of the instant invention to provide a utility enclosure system or kit which utilizes interlocking tabs and pockets to secure wall panels to a floor and/or roof.

It is still another objective of the instant invention to provide a utility enclosure system or kit which utilizes roof and floor components which interlock together for structural stability and the prevention of incursion of water into the enclosure.

It is still another objective of the present invention to provide connector members constructed to secure panels to a floor and roof structure without the need for traditional fasteners.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIGS. 6A-B are partial perspective views of the embodiment shown in FIG. 1 illustrating the assembly and connection of the left side panels to the floor assembly and rear panel;

FIGS. 8A-B are partial perspective views of the embodiment shown in FIG. 1, illustrating assembly and connection of the right side panels to each other;

FIGS. 16A-B are partial perspective views of the embodiment shown in FIG. 1, illustrating the connection of a handle to the left door;

DETAILED DESCRIPTION OF THE INVENTION

Figure 1:
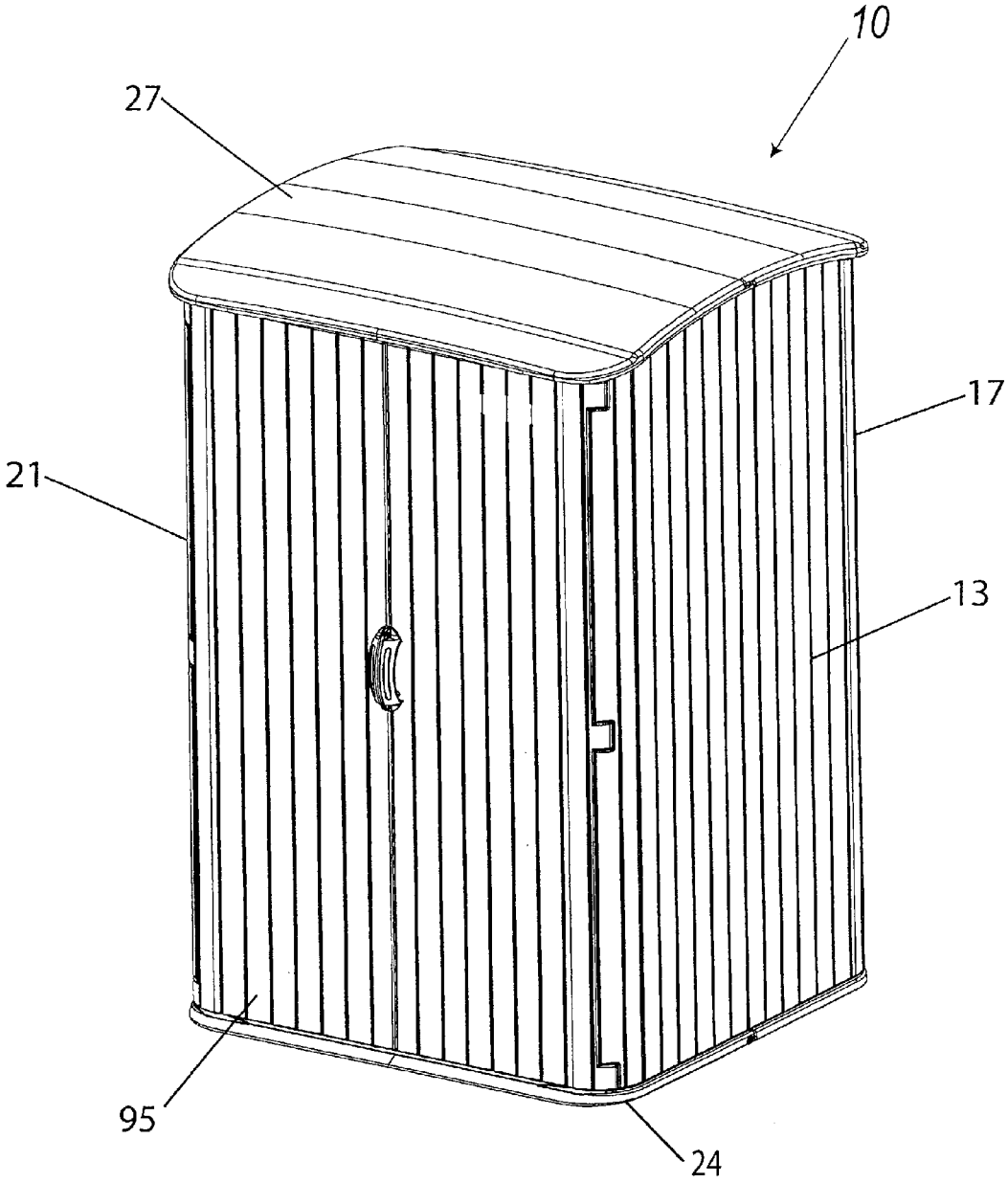
FIG. 1 is a front perspective view of one embodiment of the present invention including common roof and floor assemblies and plastic wall panels.
Figure 2C:
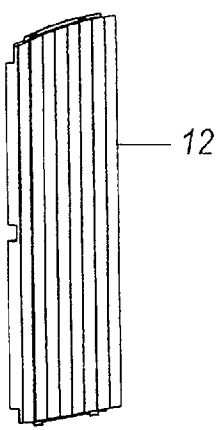
FIG. 2A-F are views of side and back panels of the embodiment illustrated in FIG. 1.
Figure 2F:
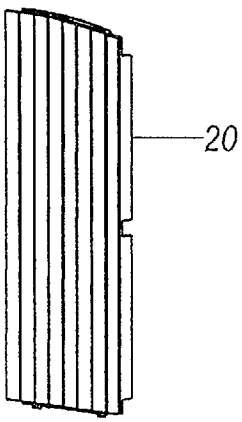
Figure 2B:
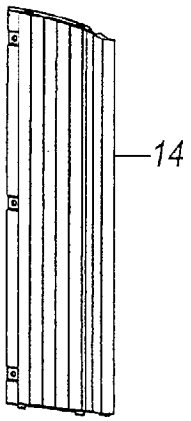
Figure 2E:
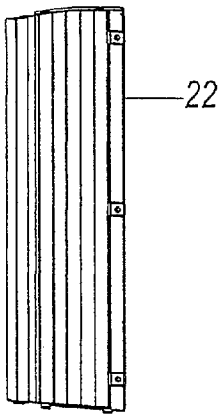
Figure 2A:
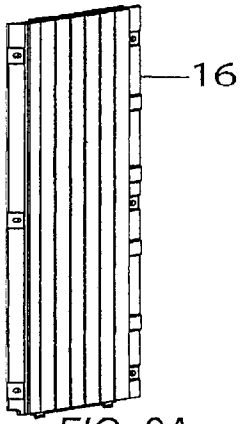
Figure 2D:
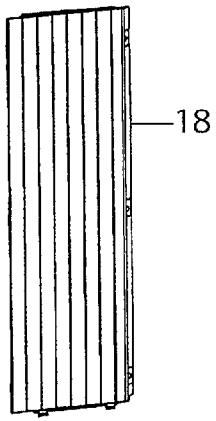

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 54:
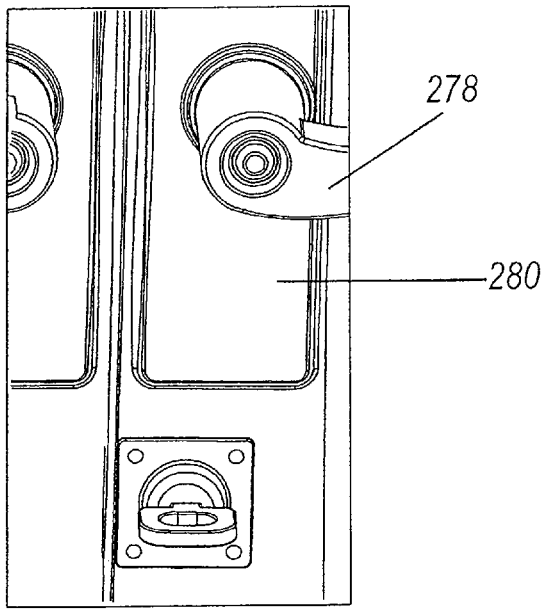
FIG. 54 is a partial perspective view of the hasp assembled to the doors.
Figure 55:
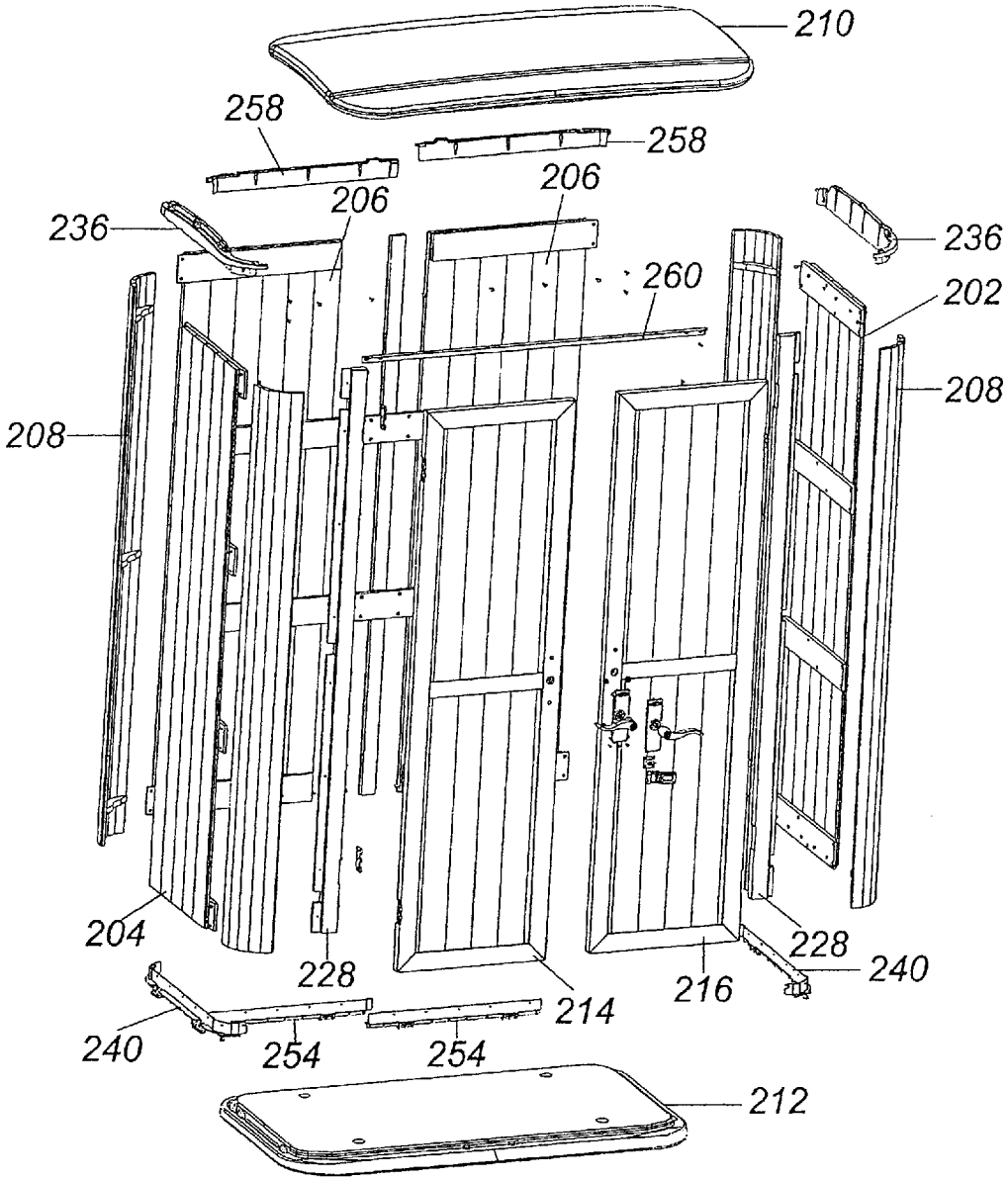
FIG. 55 is an exploded perspective view of the embodiment shown in FIG. 21.

Referring to FIGS. 1-55, a first embodiment of the present invention is illustrated in FIGS. 1-27 having plastic side wall panels and a second embodiment illustrated in FIGS. 28-55 having wooden side panels. Generally, the present invention provides a system of connectors securable to, or integrally formable to, panels to allow construction of a variety of enclosures or sheds 10. The enclosure or shed 10 includes a floor assembly 27, a roof assembly 83, a right side wall assembly 13, a back wall assembly 17, a left side wall assembly 21 and a door assembly 95. The wall assemblies may comprise one or more panels arranged in a substantially linear arrangement. In one particular embodiment, each side of the enclosure includes at least two panels, for example, right side front panel 12 and a right side rear panel 14, back right panel 16 and a back left panel 18, left side front panel 20 and a left side rear panel 22, roof front panel 26 and roof rear panel 28, floor front panel 28 and rear floor panel 26. These panels are secured to one another in a manner which will be described hereinafter.

Floor connector members 240 are either integrally formed to the bottom portion of plastic panels or secured along the bottom edge of panels constructed from dissimilar materials such as wood, metal, cement board or the like. Floor connector members 240 are preferably formed from molded plastic by the process of injection molding, and are designed with the purpose of permitting the interchangeable choice between panel materials to be secured to the floor assembly. The floor connector members 240 include a horizontal wall portion 107 (FIG. 30) that is securable or formable to the lower portion of a wall panel. A depending flange member 108 extends adjacent to a substantially vertical surface 109 of the wall panel to secure the connector to the wall panel via fasteners, adhesive or the like. A plurality of tabs 241 extend downwardly with respect to the horizontal wall portion in a spaced apart but substantially linear arrangement. The tab 241 includes at least one bend, and is preferably L-shaped for cooperating with an undercut 38 in each socket. The bend, therefore, requires the tab to enter the socket at an angle other than perpendicular, and thereafter be rotated to a perpendicular position to interlock the first portion 111 and second portion 112 of the floor connector. In at least one embodiment, the floor connector 240 includes a key member 113 extending along said second portion of said floor connector. The key member provides positive alignment with the floor panel and prevents the ingress of bugs and water into the interior portion of the structure. The floor connector may also include at least one pin member 114 extending downwardly therefrom. The pin member is generally constructed and arranged to cooperate with the floor member(s) to locate the second portion of the floor connector with respect to the first portion of the floor connector.

Figures 3A, 3B, 3C:
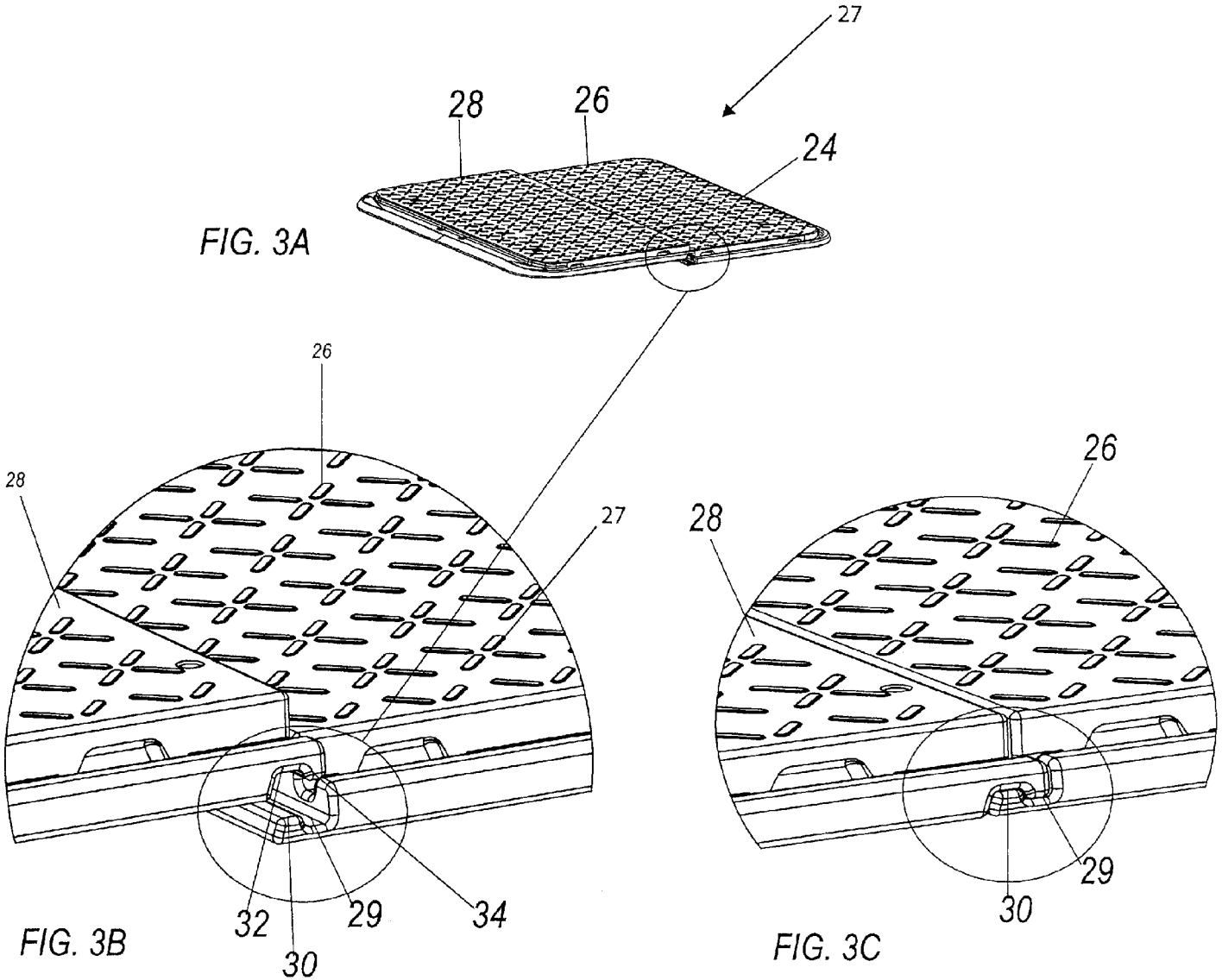
FIGS. 3A-C are perspective views of the floor assembly of the embodiment shown in FIG. 1, illustrating the interlocking connection of the floor components.

The floor assembly 27 preferably includes at least two floor panels 26 and 28 which are secured to each other to form the floor of the enclosure. In an alternative configuration, the floor assembly 27 is one solid floor panel 212 formed from a material such as plastic, FIG. 55. As can be seen in FIGS. 3A-C, the floor panels 26 and 28 are secured to each other along a longitudinal edge of each panel. The panel 26 includes an upwardly facing groove 29, FIG. 3B, which extends along a longitudinal edge thereof. Adjacent the groove 29 is a lip or upturned ridge 30. The lip or ridge 30 extends along the length of groove 29 and is adjacent thereto. Floor panel 28 includes a downwardly facing groove 32, FIG. 3B, which extends along a longitudinal edge thereof. Adjacent groove 32 is a lip or ridge 34 which extends along the length of the groove 32. Lip 34 is constructed sized to mate with groove 29. Lip 30 is constructed and sized to mate with groove 32. The structural inter-fitting of the lips into the grooves provides structural integrity and support for the connection of the floor panels 26 and 28 to each other. This structural relationship also provides a seal or boundary which prevents the intrusion of water or other fluids from passing from the bottom of the panels to the top of the panels. This structure therefore prevents water or other fluids from entering into the enclosure or shed from below. In addition, fasteners, such as screws, may be utilized to connect the floor panels 26 and 28 together.

Figures 4A, 4B:
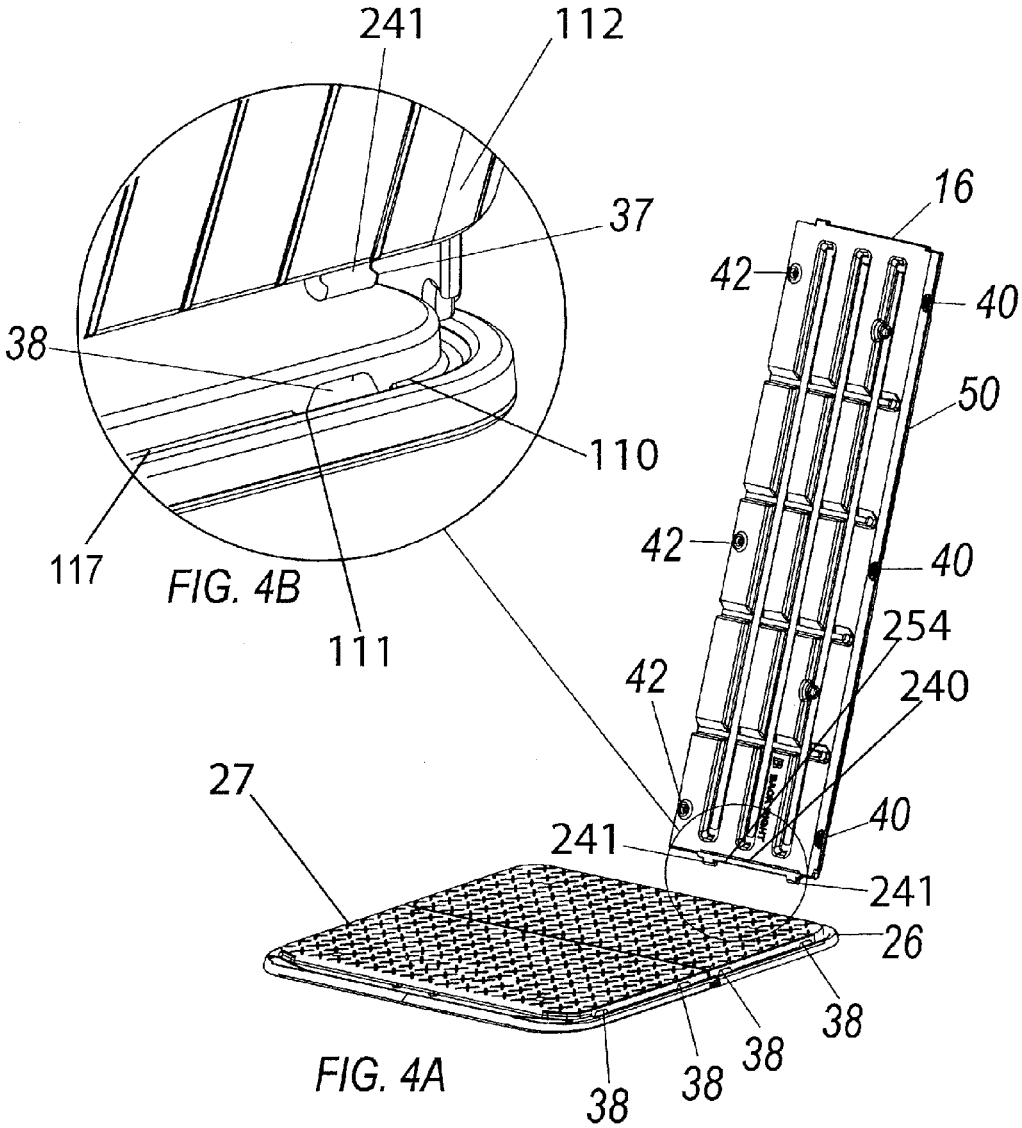
FIGS. 4A-B are partial perspective views of the embodiment shown in FIG. 1, illustrating the assembly and connection of the rear panel to the floor assembly.

FIGS. 4A and B illustrate the manner in which floor connector 240 couples rear panel 16 to a floor panel 26. Floor connector 240 includes a plurality of tabs 241 formed to or secured along a bottom portion or edge of the rear panel 16. The plurality of tabs 241 may be formed as curved members that include a bend of substantially 90 degrees, as seen in FIG. 4B. A peripheral portion of both floor panels 26 and 28 include apertures or slots 38 having an undercut 110, FIGS. 4A and B. The tabs 241 fit into the groove 117 and engage the undercut 110 portion of the floor panel 26 to secure the rear panel 16 to the floor panel 26. This engagement is accomplished by tilting the top of the rear panel 16 downwardly prior to inserting the tabs 241 into the slots 38. Next, panel 16 is returned to its upright, vertical position. This moves the outer edge 37 of tabs 241 below the peripheral portion of the floor panel and prevents the rear panel 16 from moving upwardly and thus becoming detached from the floor panel.

Rear panel 16 also includes apertures 40 and 42 which will be described hereinafter.

Figures 5A, 5B, 5C, 5D:
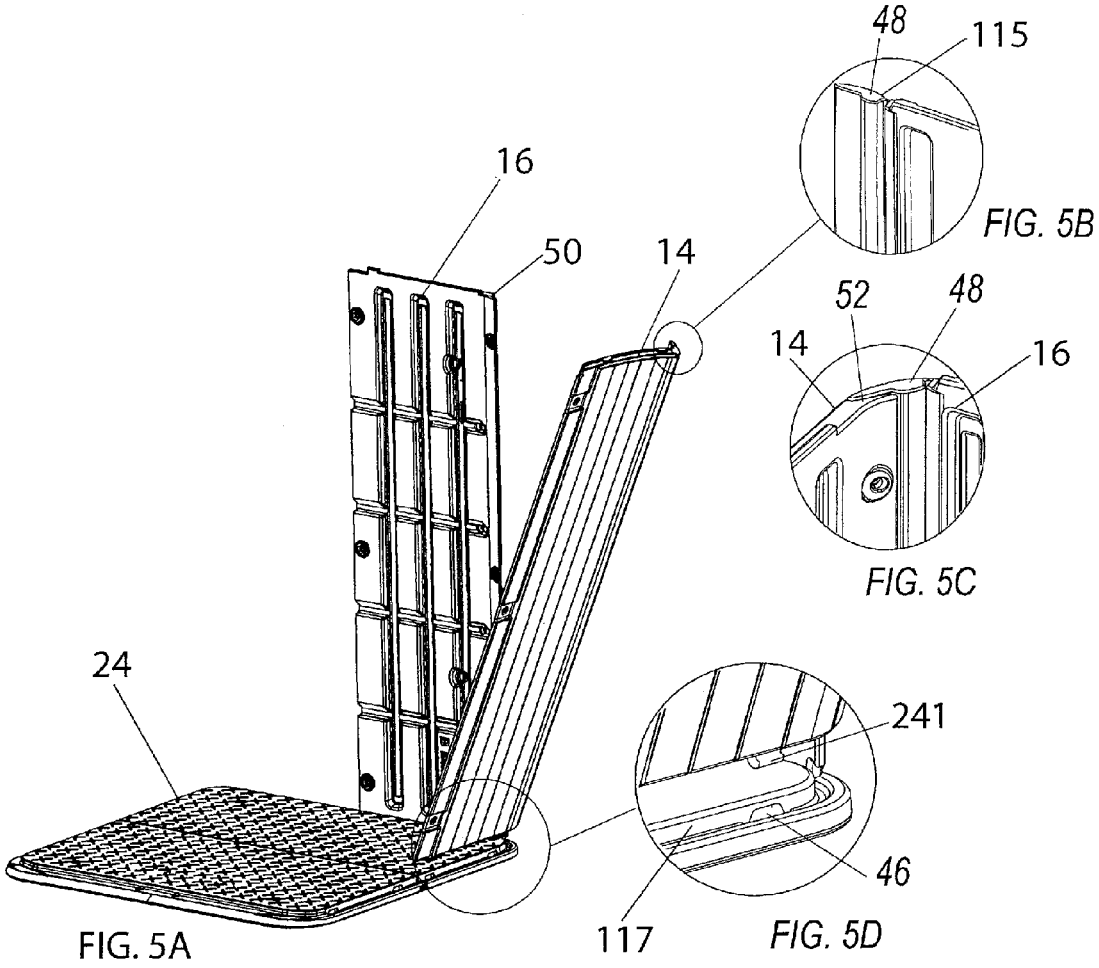
FIGS. 5A-D are partial perspective views of the embodiment shown in FIG. 1, illustrating assembly and connection of the right side panels to the floor assembly and the assembly of the corner extending between the rear and side panels.
Figure 6A:
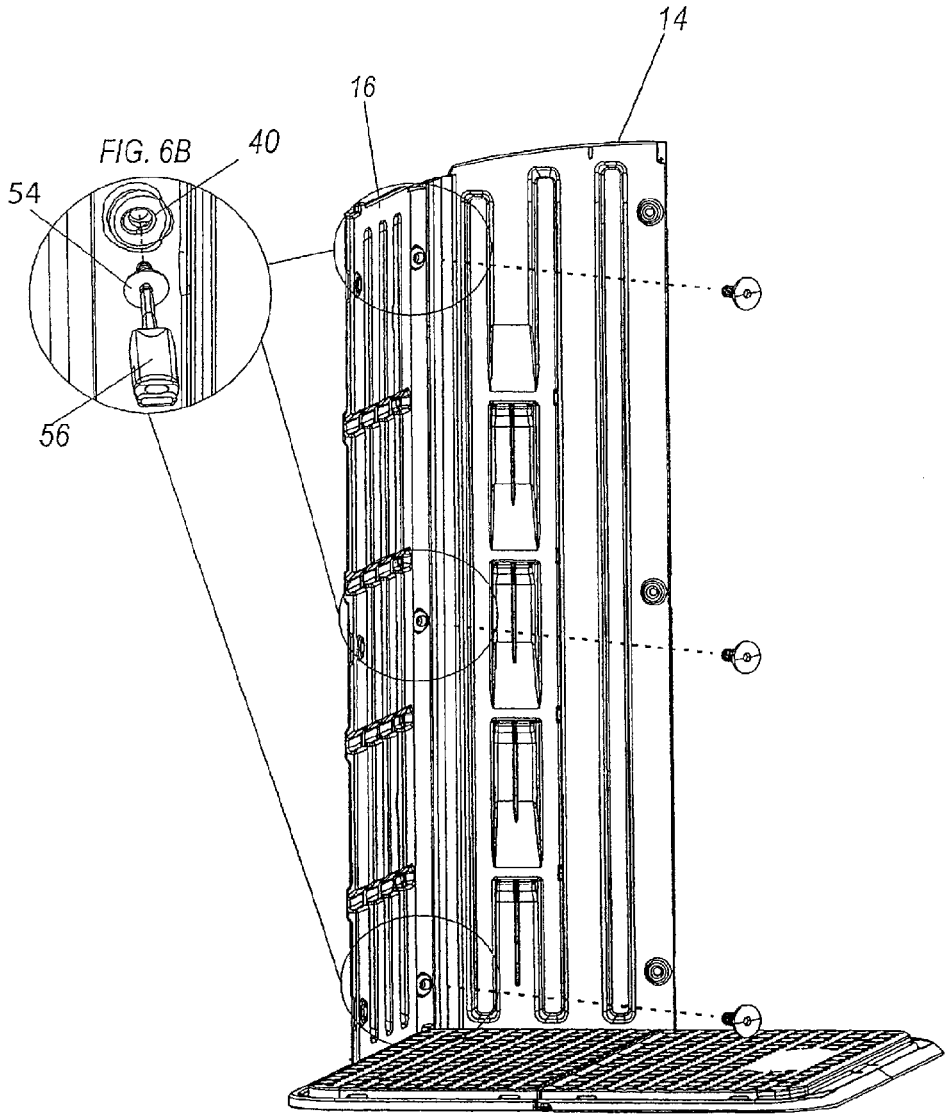

A right side rear panel 14 is illustrated in FIGS. 5A-D. It is secured to the floor assembly 24 utilizing the same construction and elements that rear panel 16 utilizes to be secured to the floor assembly 24. Tabs 241 on the bottom portion or lower edge of right side rear panel 14 fit into apertures or slots 38 having an undercut 110 on the peripheral portion of the floor panel 26 to secure the right side rear panel 14 onto the floor panel 26. This engagement is accomplished by tilting the top of the right side rear panel 14 downwardly prior to inserting the tabs 241 into the slots 38. Next, panel 14 is returned to its upright, vertical position. This moves the outer edge of tabs 241 below the peripheral portion of the floor panel and prevents the right side rear panel 14 from moving upwardly and thus becoming detached from the floor panel. Right side rear panel 14 also includes a corner member or flap 48 (FIG. 5B) which is secured to panel 14 along an edge portion via a living hinge 115. Corner member 48 engages and is secured along an edge 50 of rear panel 16 (FIG. 5C). Corner member 48 fits into a panel edge groove 52 which extends along the edge 50. This enables the outer surface of the corner member 48 to be flush with the outer surface of rear panel 16. This presents an aesthetically pleasing appearance to the outer portion of the enclosure 10. Fastening elements 54, such as screws, are employed to secure corner member 48 to rear panel 16. The fastening elements 54 pass through the apertures 40 in panel 16 and engage corner member 48, thus securing panels 16 and 14 to each other, as illustrated in FIG. 6A. A tool 56, such as a screwdriver, is employed to connect fastening elements 54 to panel 14.

Figures 7A, 7B, 7C:
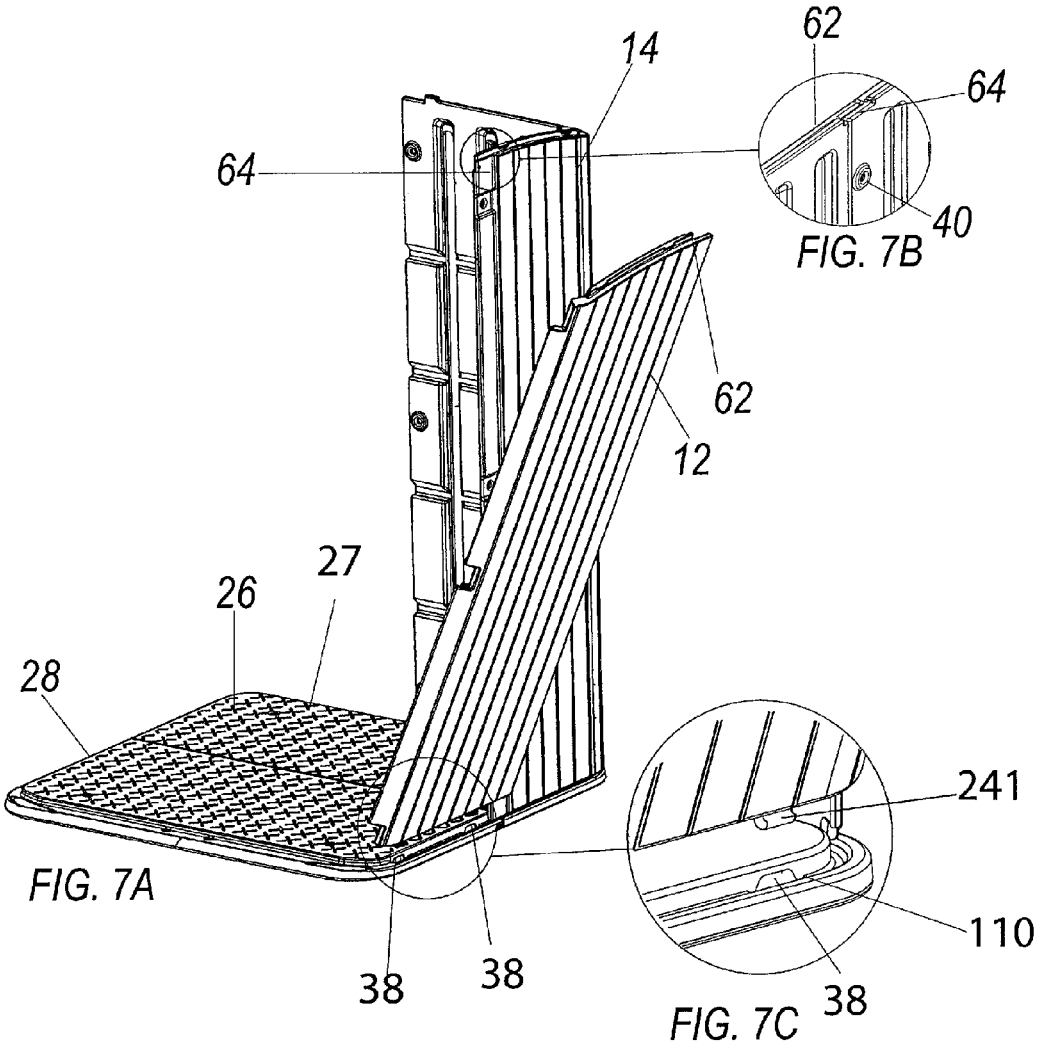
FIGS. 7A-C are partial perspective views of the embodiment shown in FIG. 1, illustrating assembly and connection of the right side panels to the floor assembly and another side panel.
Figure 8A:
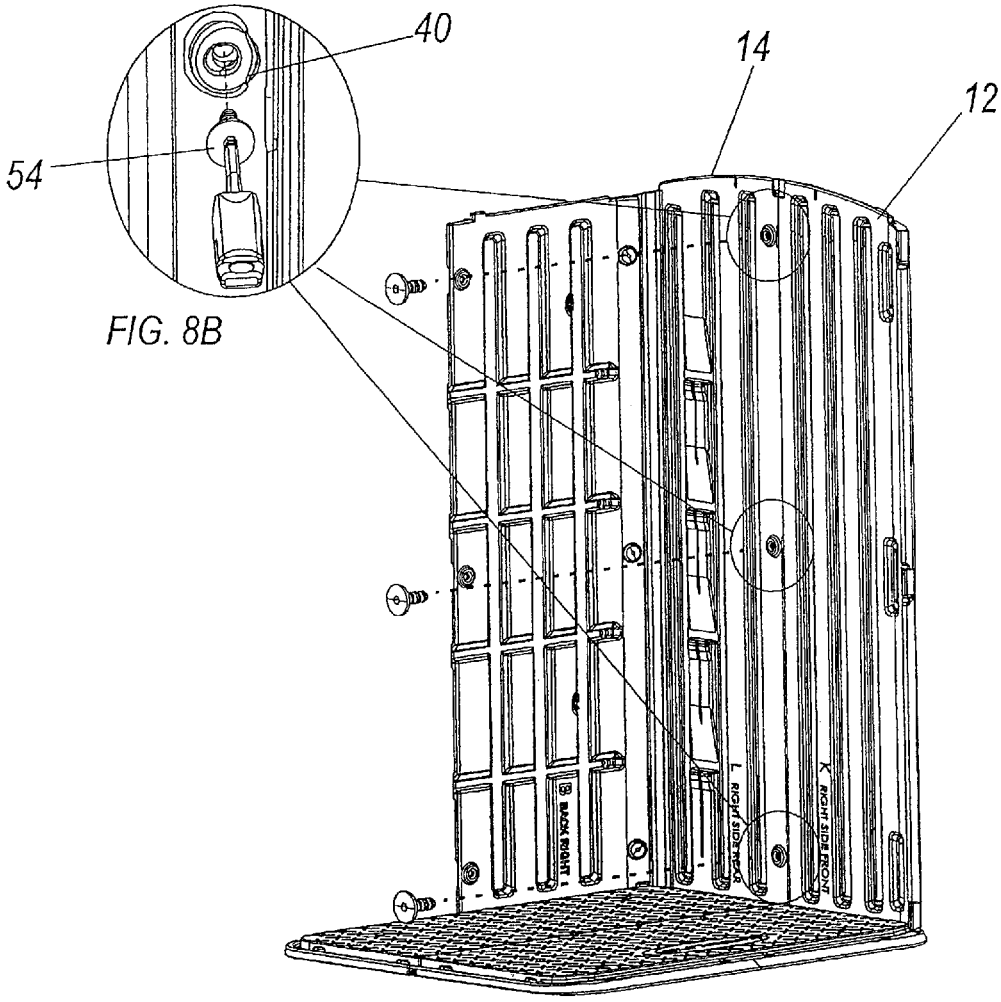

A right side front panel 12 and right side rear panel are illustrated in FIGS. 7A and 8A. The right side front panel 12 includes a plurality of tabs 241 on the bottom portion or lower edge of right side front panel 12 which fit into apertures or slots 38 on the peripheral portion of the floor panel 28 to secure the right side front panel 12 onto the floor panel 28. This engagement is accomplished in a manner similar to the securing of panel 14 to floor panel 26. The right side front panel 12 includes an offset 62 which extends along the length of the panel. The right side rear panel 14 includes an offset 64 which extends along the length of the panel. Offsets 62 and 64 are constructed and arranged to mate with each other so as to enable panels 12 and 14 to be joined together without increasing the thickness of the panels to present an aesthetically pleasing appearance. The offsets 62 and 64 further provide a connection between panels 12 and 14 which does not distract from the inner or outer surfaces of the panels while creating a weather-tight and bug resistant connection. Fasteners 54 are utilized to secure panels 12 and 14 together, as illustrated in FIGS. 8A and B. Fasteners 54 pass through apertures 40 in panel 12 and are screwed in panel 14, thus securing panels 12 and 14 together.

Figures 9A, 9B:
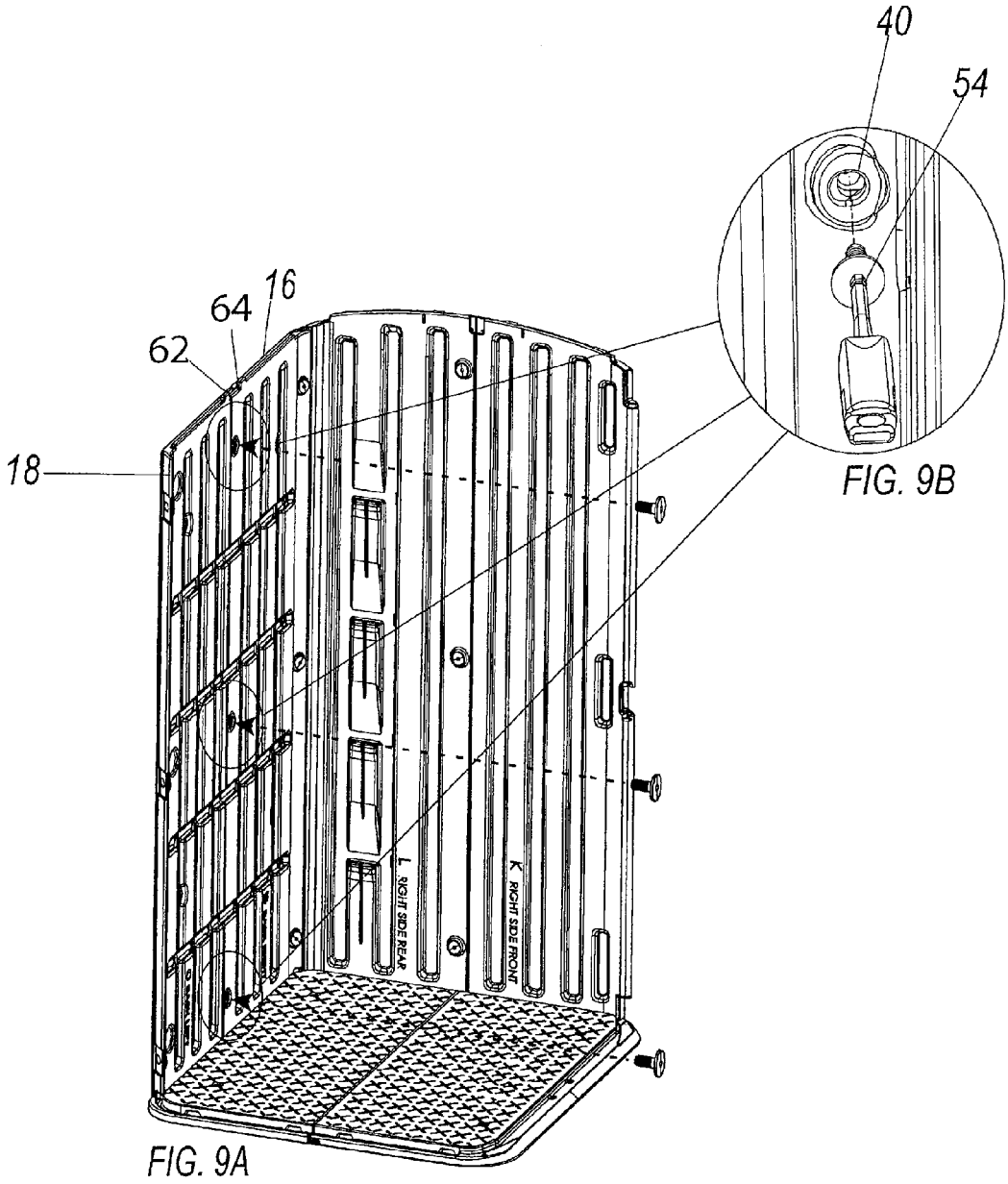
FIGS. 9A-B are partial perspective views of the embodiment shown in FIG. 1, illustrating assembly and connection of the rear panels to each other.

FIGS. 9A and B illustrate the right and left back panels 16 and 18 secured to floor panel 26. The back panel 18 is secured to the floor panel utilizing tabs 241 on the back panel and apertures 38 on the floor panel 26; similar to the manner in which back panel 16 is secured to floor panel 26. Back panels 16 and 18 also include offsets 62 and 64 respectively along their length. Offsets 62 and 64 are constructed and arranged to mate with each other. Fasteners 54 pass through apertures 40 in panel 16 and are screwed into panel 18 so as to secure panels 16 and 18 together. This connection is similar to the connection which joins panels 12 and 14 together.

Figures 12A, 12B, 12C:
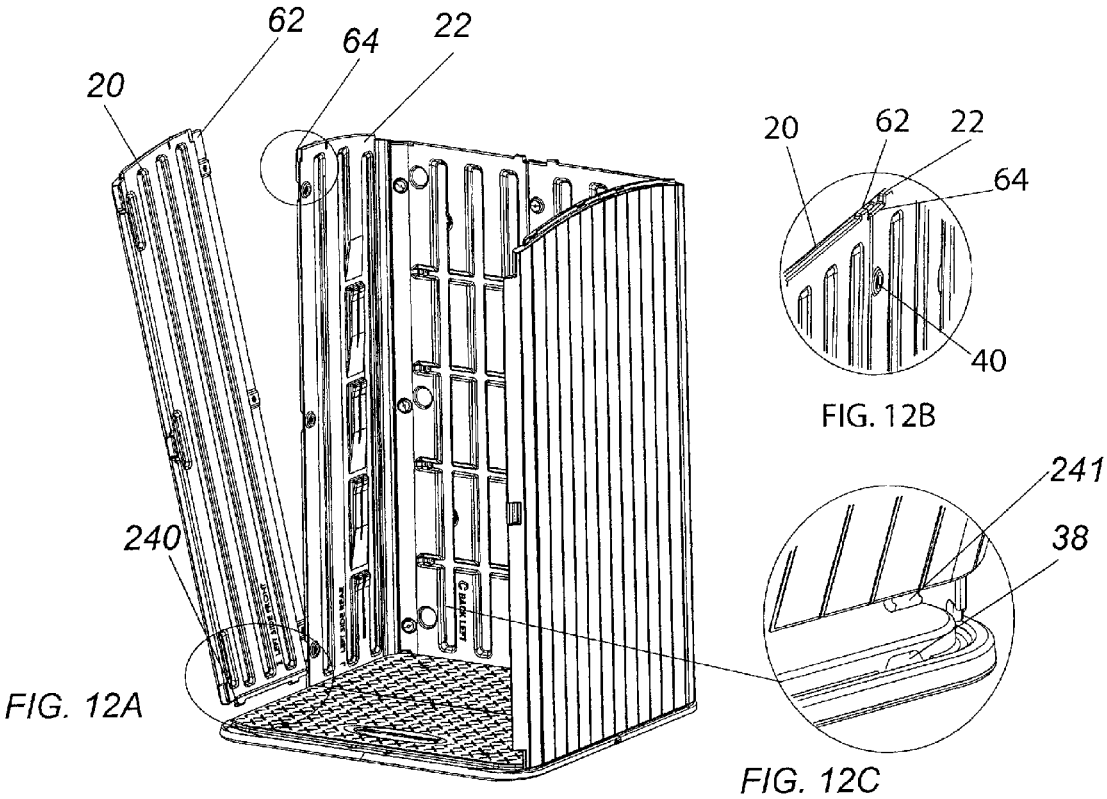
FIGS. 12A-C are partial perspective views of the embodiment shown in FIG. 1, illustrating connection between the left side panels.
Figures 13A, 13B, 13C:
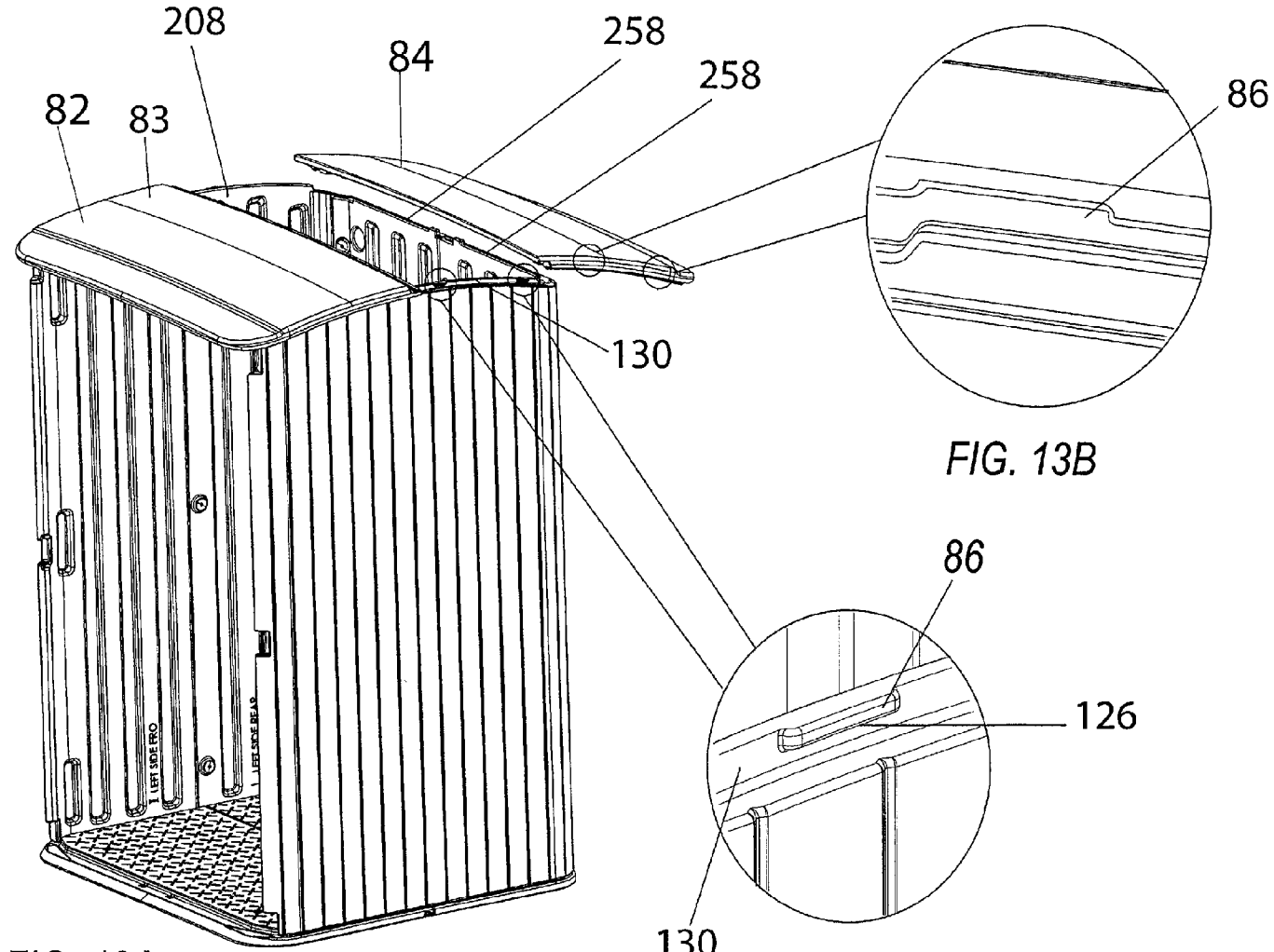
FIGS. 13A-C are partial perspective views of the embodiment shown in FIG. 1, illustrating assembly of the roof panels to the side panels.

FIGS. 12A-C illustrate the connection of left side panels 20 and 22 to each other, and their installation onto floor panels 26 and 28. Left side front panel 20, secured to floor connector 240, includes a plurality of tabs 241 formed to or secured along a bottom portion or edge. Tabs 241 fit into apertures 38 on floor panel 28. Panel 20 is secured to floor panel 28 in a manner similar to that of panel 16 being secured to floor panel 26. Left side rear panel 22 also secures to floor connector member 240 and includes tabs (not shown) along a bottom portion thereof. These tabs fit into apertures 38 in floor panel 26 and thus secure panel 22 to floor panel 26 in a manner similar to that employed to secure panel 20 to floor panel 28. Left side panels 20 and 22 include offsets 62 and 64, respectively, which extend along their length. Offsets 62 and 64 are constructed and arranged to mate with each other so as to enable panels 20 and 22 to be joined together. The offsets 62 and 64 further provide a connection between panels 20 and 22 which does not distract from the inner or outer surfaces of the panels. The grooves also present an aesthetically pleasing appearance of a single said wall of the utility enclosure. Fasteners 54 are utilized to secure panels 20 and 22 together. Fasteners 54 pass through apertures 40 in panel 22 and are screwed in panel 20, thus securing panels 20 and 22 together.

Figures 10A, 10B, 10C, 10D:
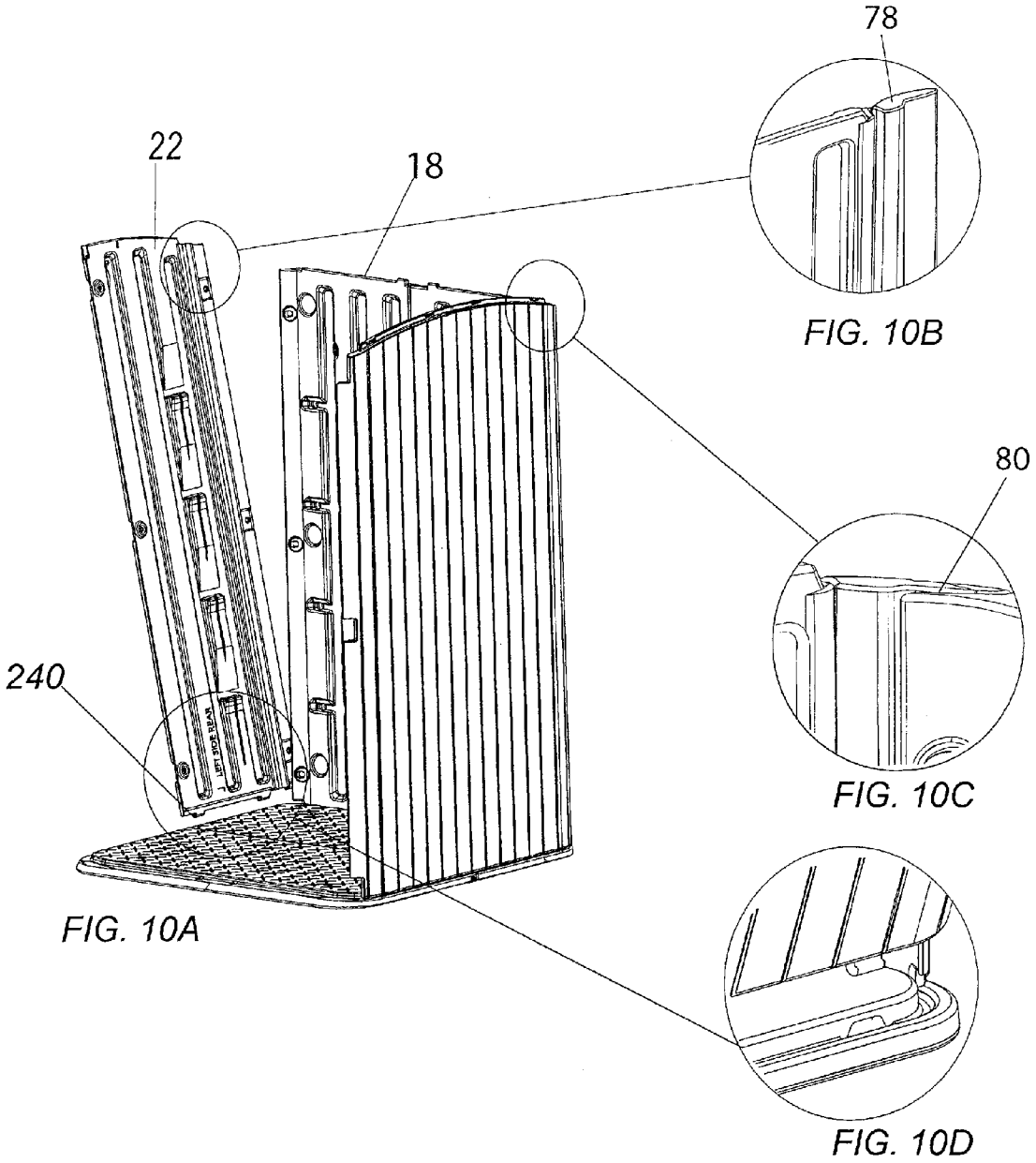
FIGS. 10A-D are partial perspective views of the embodiment shown in FIG. 1, illustrating assembly and connection of one left side panel to the floor assembly.
Figures 11A, 11B:
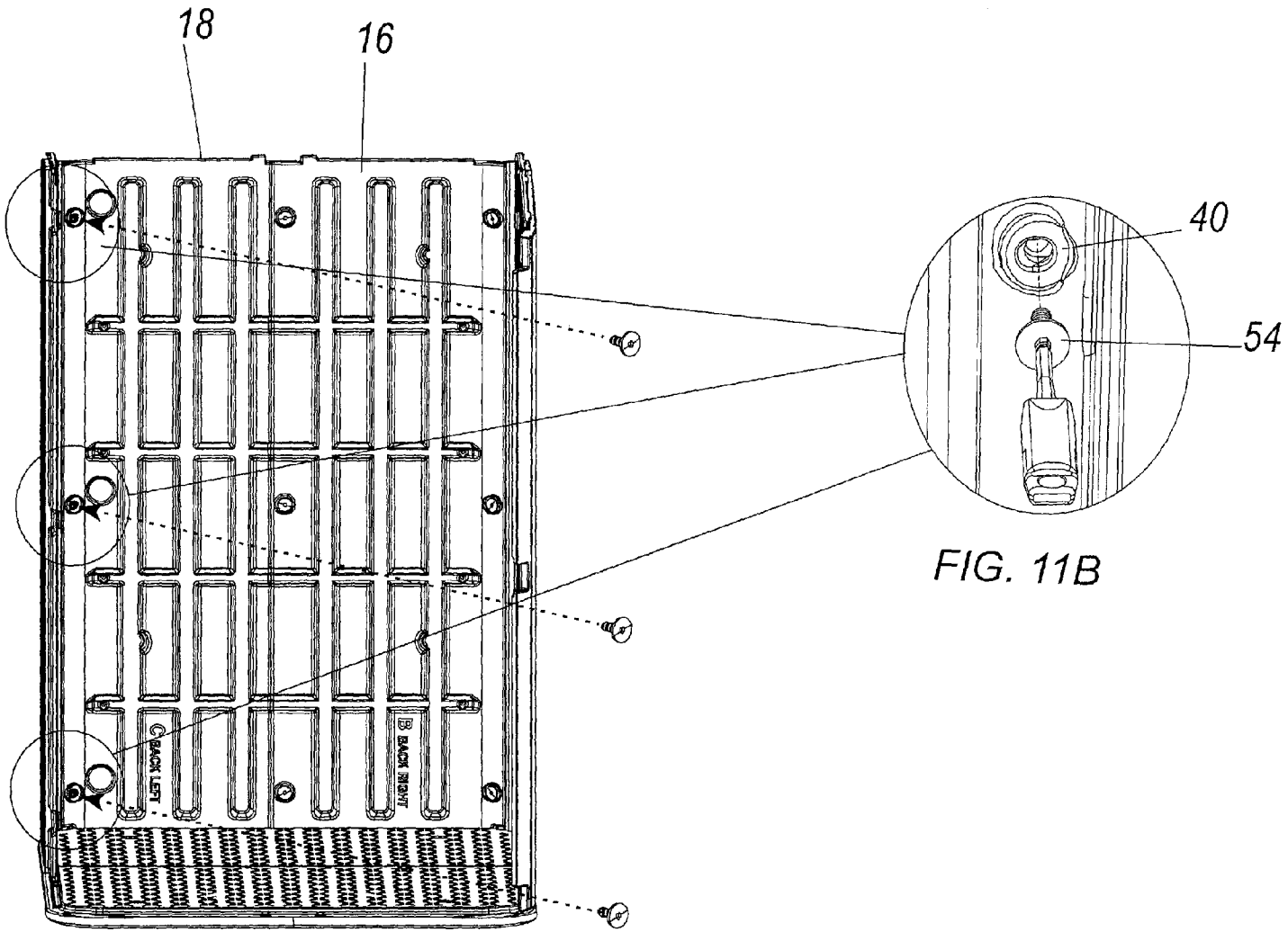
FIGS. 11A-B are partial perspective views of the embodiment shown in FIG. 1, illustrating assembly of the left side panels to the rear panels.

FIGS. 10B-C illustrate the connection between left side rear panel 22 and left back panel 18. Left side rear panel 22 includes a corner member or flap 78 (FIG. 10B) which is hingedly secured along an edge portion. Corner member 78 fits into a groove 80 which extends along an edge of panel 18. This enables the outer surface of the corner member 78 to be flush with the outer surface of panel 18. This presents an aesthetically pleasing appearance to the outer portion of enclosure 10. Fastening elements 54, such as screws, are employed to secure panels 22 and 18 together, similar to the manner in which the other panels are secured to each other. FIGS. 12A-B illustrate the manner in which fastening elements 54 secure panels 22 and 18 together.

Figure 46:
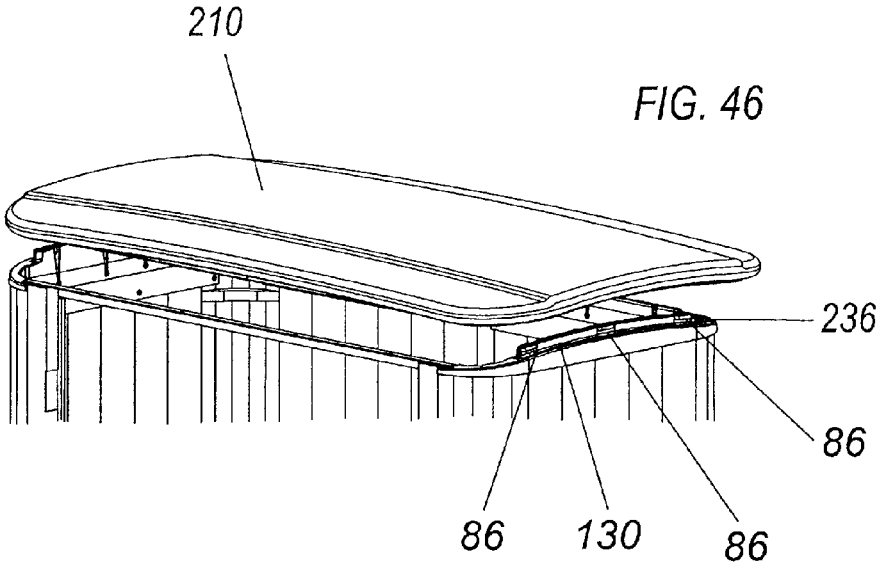
FIG. 46 is a partial perspective view of the embodiment shown in FIG. 21, illustrating assembly of a roof panel to the top connectors.
Figure 47:
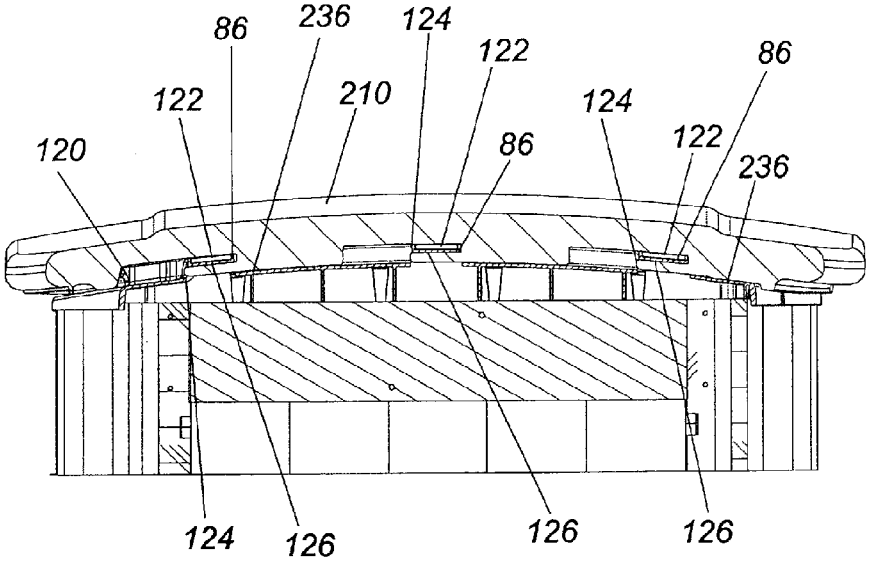
FIG. 47 is a partial cross sectional view taken along lines 47-47 of FIG. 21, illustrating connection of the roof panel to the top connectors.
Figure 48:
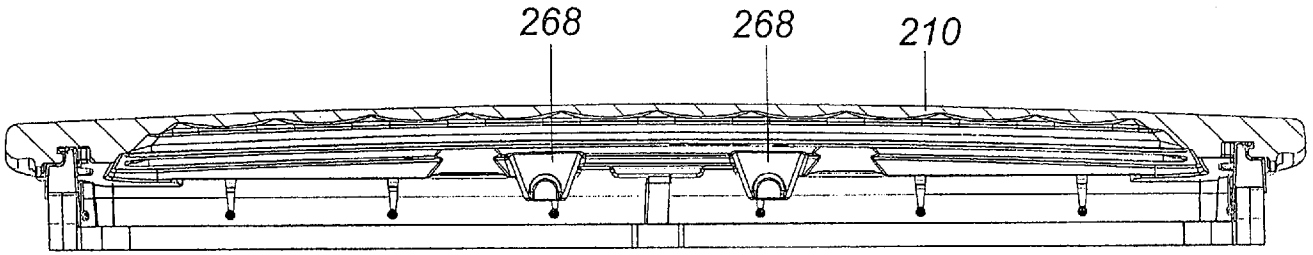
FIG. 48 is a partial cross sectional view taken along lines 48-48 of FIG. 21, illustrating connection of the roof panel to the top connectors.

Referring to FIGS. 13-15 and 46-48, assembly of the roof is illustrated. The roof assembly 83 includes at least one panel 82, 84 of molded plastic. In FIG. 46, the roof assembly is illustrated as a single roof panel 210. In all configurations, roof assemblies are made from molded plastic, preferably formed by blow molding to form a double wall structure. The upper surface of the roof panels 82, 84 and 210 are preferably curved along their lateral dimension to enable rain, snow and other elements of the weather to readily roll off the roof. This prevents accumulation of water, etc. on the roof which can lead to water leaking into the enclosure 10. Each of the roof panels 82 and 84 include the second portion of the roof connector, illustrated herein as at least one and preferably a plurality of bayonet slots 86 formed therein on an inside edge at each end of the panels, as illustrated in FIGS. 47 and 48. Each bayonet slot 86 includes a receiving portion 120 and a ramp portion 124 extending from said receiving portion. The receiving portion is generally sized and shaped to accept a key 122 positioned on the top surface of the wall panels. The ramp surface is arranged to cooperate with a bearing surface 126 of the key during linear translation of the roof panel to cause the roof panel to pull tightly against a top surface of the wall panels. At least one stop member 268 is positioned on the bottom surface of each wall panel to cooperate with an inner surface of a wall panel once the roof panel has been translated a predetermined distance to prevent the roof panel from moving in an opposite direction.

Figures 14A, 14B:
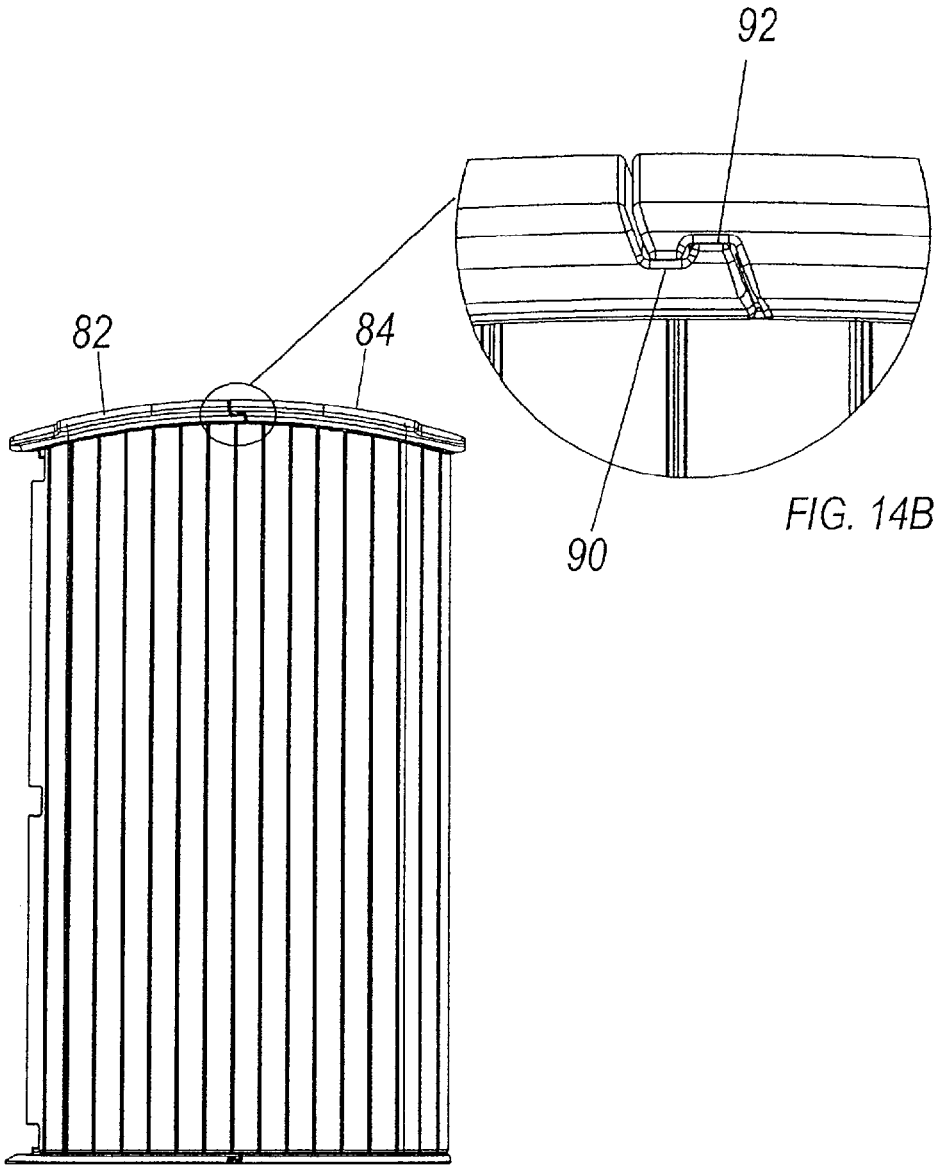
FIGS. 14A-B are partial side views of the embodiment shown in FIG. 1, illustrating the assembled connection of the components of the roof assembly to each other and the wall panels.

When the roof assembly includes two or more panels, each of the roof panels is separately placed on the enclosure 10. The roof panels are placed atop the side panels, offset to the front or rear of the enclosure. The panels are then slid or moved toward the center of the enclosure 10. The keys 122 on the side panels are then slid in and engage the bayonet slots 86. Each of the roof panels 82 and 84 are provided with a channel 90 and 92, respectively, along a longitudinal edge thereof. The channels 90 and 92 are formed as compliments to each other so that when the channels 90 and 92 are engaged they form an interlocking seal between roof panels 82 and 84 (FIG. 14B). This interlocking seal holds the panels together and prevents the intrusion of water or other fluids into the enclosure.

Referring to FIGS. 13, 28, 29, 43, 44 and 46, the first portion of the roof connector 236 is illustrated. Each of the side panels 12, 14, 20 and 22 include the first portion of the roof connector secured or integrally formed thereto. The first portion of the roof connector includes a flange portion 130 that extends upward beyond a top surface of each wall panel. The flange includes a plurality of key members 122 extending outwardly from the vertical flange, the key member having a bearing surface 126 on a bottom portion thereof. In at least one embodiment, the first portion of the roof connector includes a second flange 132 extending outwardly from the first flange 130. The second flange 132 is constructed and arranged to fit adjacent to bottom surface of a wall panel. A third flange 134 depends from the second flange to form a U-shaped trough that is sized to fit around an inner, an outer and a bottom surface of a wall panel. The first flange may include apertures for fasteners, adhesive or the like to connect the first portion of the roof connector to the panel, or alternatively, the first portion of the roof connector may be integrally formed to end portion of the panel.

Figures 15A, 15B, 15C, 15D:
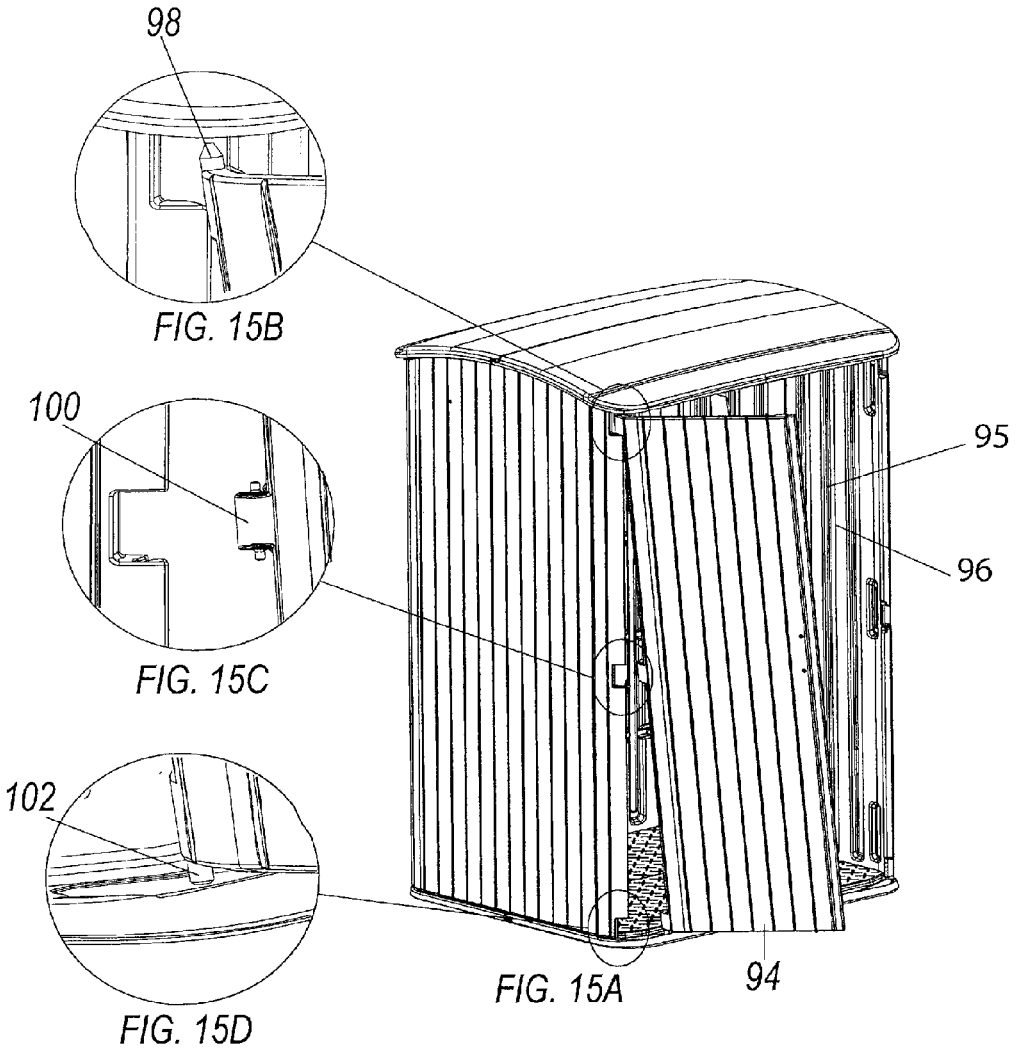
FIGS. 15A-D are partial perspective views of the embodiment shown in FIG. 1, illustrating assembly of the left door panel to the side panels.
Figure 16A:
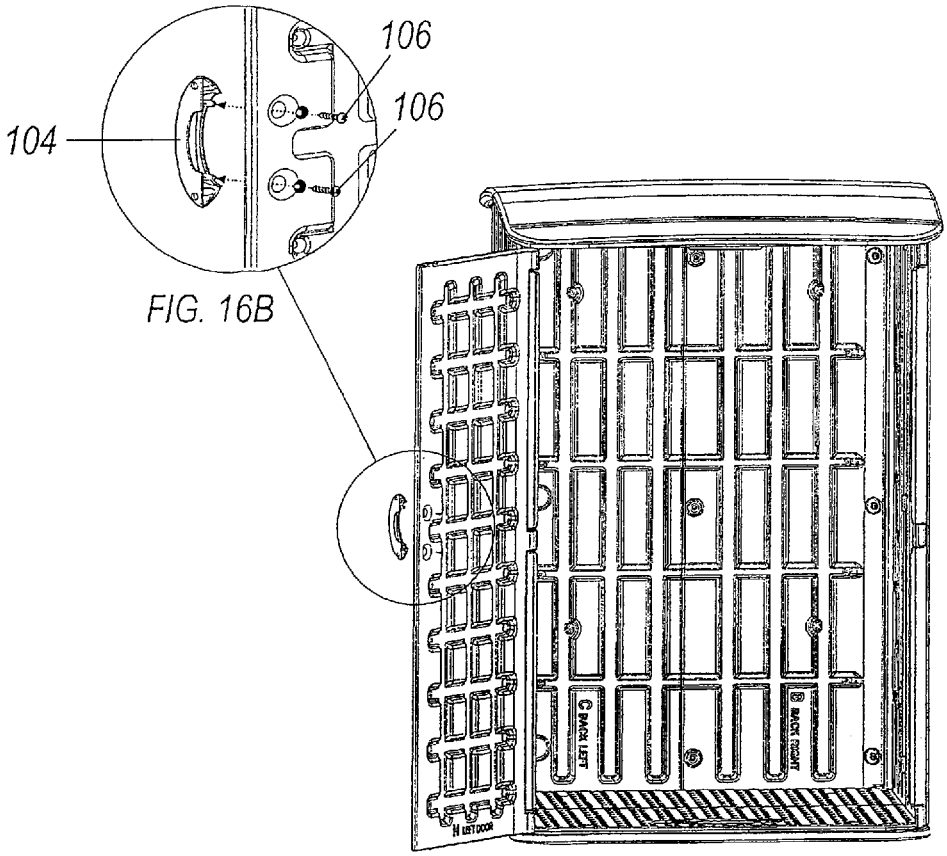
Figures 17A, 17B, 17C, 17D:
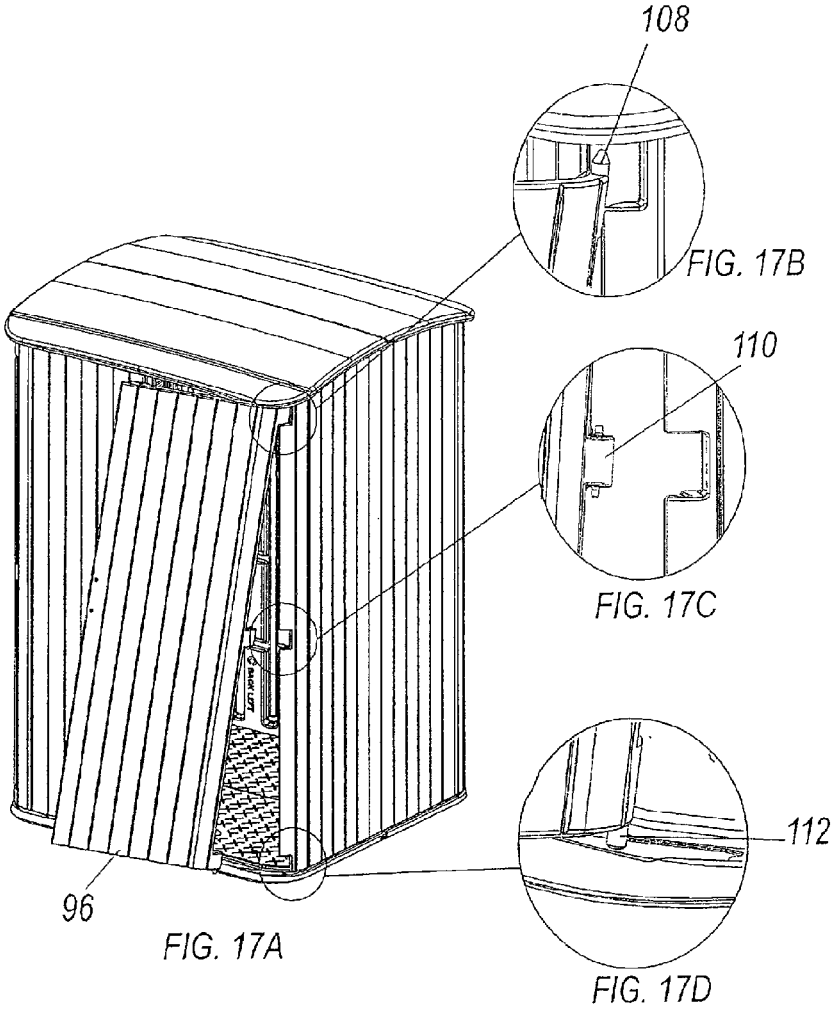
FIGS. 17A-D are partial perspective views of the embodiment shown in FIG. 1, illustrating assembly of the right door panel to the right side panels.

Referring to FIGS. 15-18 and 49-54, construction of the door assembly is illustrated. The front of the enclosure 10 includes a door assembly 95 which comprises one or two door panels. A left door panel 94 (FIG. 15A) and a right door panel 96 (FIG. 17A). The door panels are hingedly secured to the side panels, as illustrated in FIGS. 15-17. Left door panel 94 is hingedly secured to left front panel 20 with three hinges 98, 100, and 102, as illustrated in FIGS. 15B, 15C and 15D respectively. Hinges 98, 100, and 102 are slid into apertures on panel 20. These apertures 40 retain the hinge members and prevent their disengagement from the side panel. The apertures also permit the hinge members to pivot which permits the doors to open and close. Door panel 94 is also provided with a handle 104 to assist the opening and closing of the door panel. Handle 104 is secured to the door panel with fasteners 106.

Right door panel 96 is hingedly secured to right front panel 12 with three hinges 108, 110, and 112, as illustrated in FIGS. 17B, 17C and 17D respectively. Hinges 108, 110, and 112 are slid into apertures on panel 12. These apertures retain the hinge members and prevent their disengagement from the side panel. The apertures also permit the hinge members to pivot which permits the doors to open and close. Door panel 96 is also provided with a handle (not shown) to assist the opening and closing of the door panel. The handle is secured to the door panel with fasteners similar to 106.

Figures 49A, 49B:
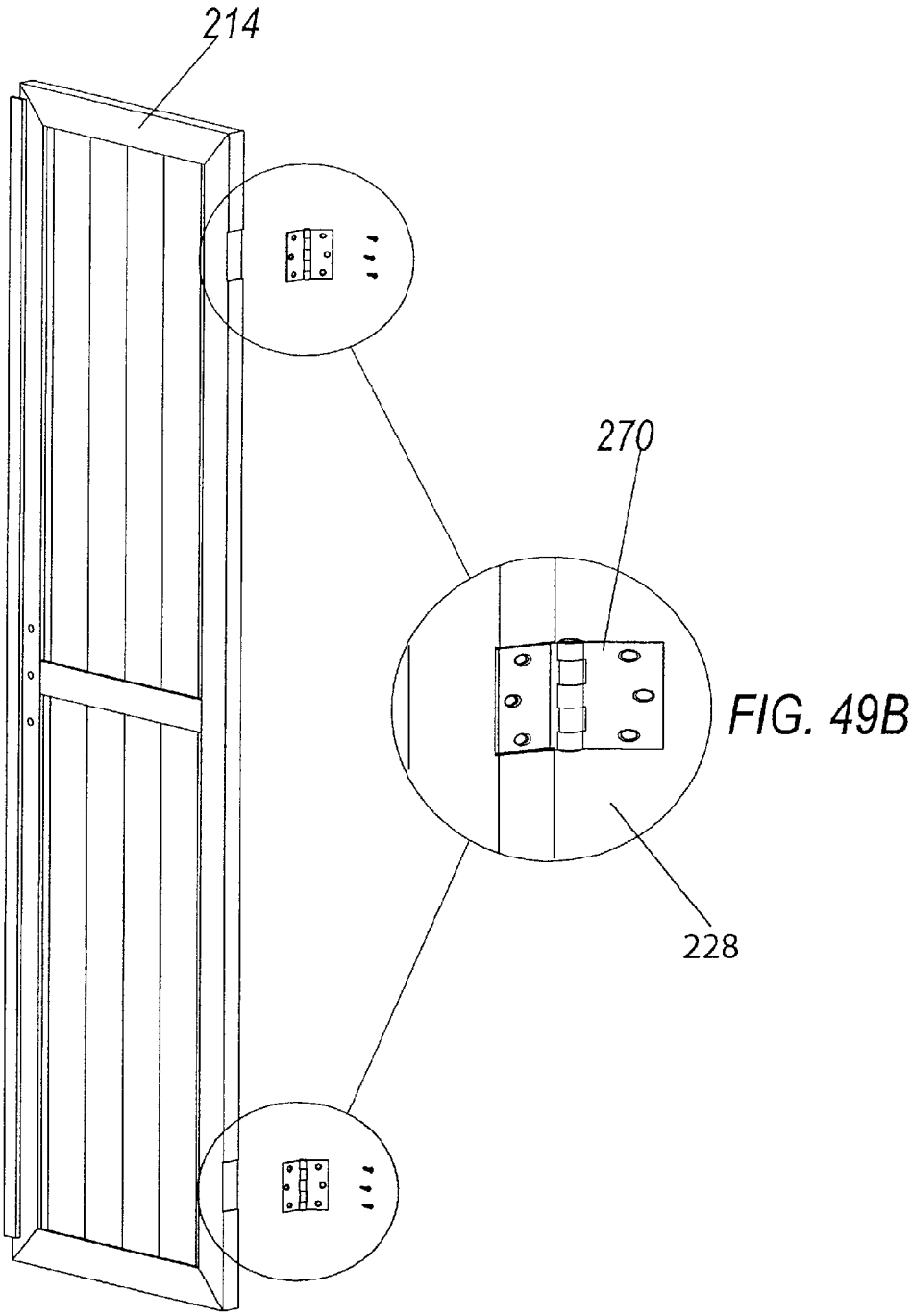
FIGS. 49A-B are partial perspective views of the embodiment shown in FIG. 21, illustrating assembly of hinges to the left door panel.
Figure 50A:
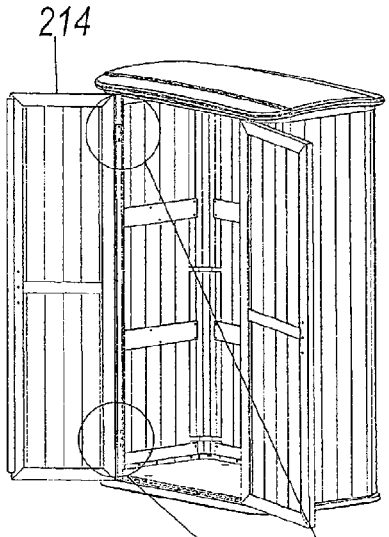
FIGS. 50A-B are partial perspective views illustrating the assembled hinges of the left door.
Figure 50B:
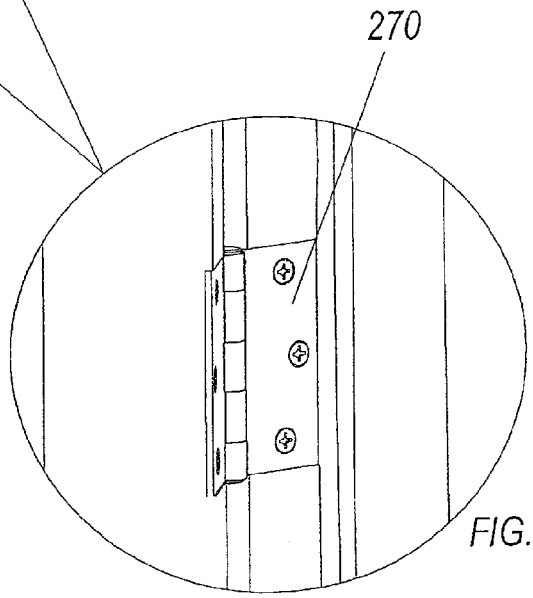

FIGS. 49A-B and 55 illustrate the left door 214 and hinges 270 which are employed to secure the door to the face frame 228. Fasteners, such as screws, are used to secure the hinges 270 to the door and the face frame. FIGS. 50A-B also illustrate the manner in which the door 214 is secured to the face frame. In a preferred embodiment, the edges of the door 214 and the face frame 228 are mortised to permit the hinges to be mounted flush with the surfaces of the door and face frame, as illustrated in FIGS. 50A-B.

Figure 51:
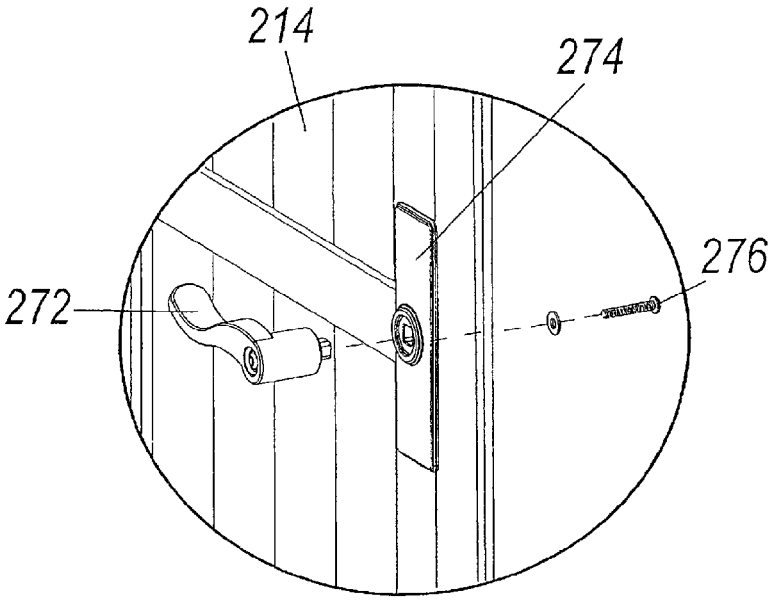
FIG. 51 is a partial perspective view of a door handle being installed on the left door.
Figure 52B:
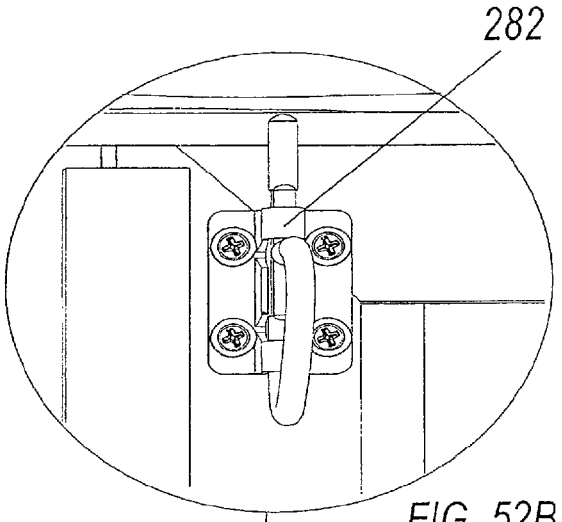
FIGS. 52A-B are partial perspective views of the embodiment shown in FIG. 21, illustrated with the back panels removed to show a slide bolt being installed on the left door.
Figure 52A:
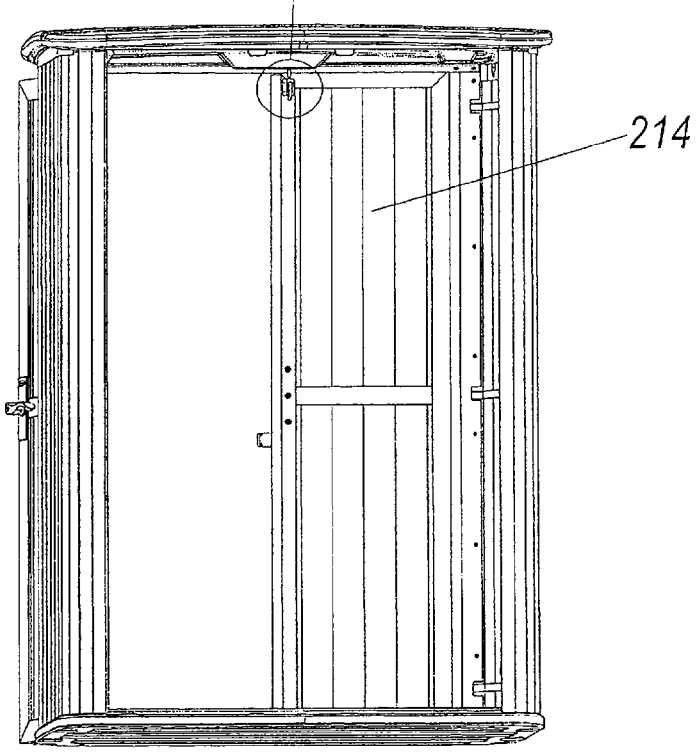

FIG. 51 illustrates the manner in which a door handle 272 and face plate 274 are secured to door 214. A fastener 276 is employed to secure the handle 272 and face plate 274 to the door. A similar handle 278 and face plate 280 are secured to the right hand door 216 in the same manner (FIG. 54). A slide bolt 282 is secured to the top of the left door 214 (FIG. 52B). The slide bolt moves up and down to engage and disengage an aperture in header 260. When the slide bolt engages header 260 (FIG. 55) it locks the door 214 in a closed position. To open the door, one simply lowers the slide bolt 282 until it disengages the header. The door 214 can now be opened.

Figure 53:
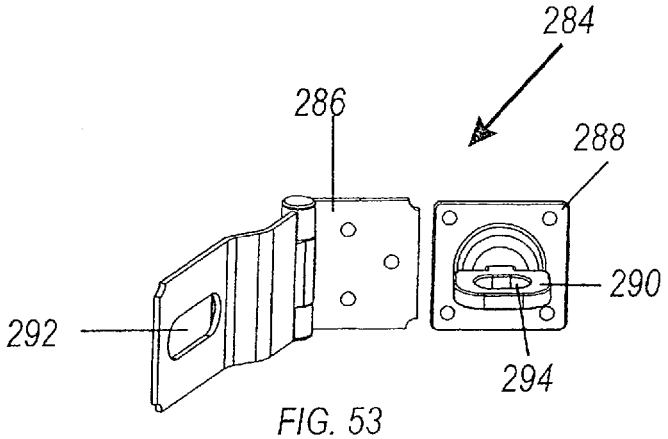
FIG. 53 is a perspective view of a hasp to be installed on the doors.

FIG. 53 illustrates a hasp 284 which is installed on the doors 214 and 216 to lock the door in a closed position. The hasp includes a left portion 286 and a right portion 288. The right portion 288 includes a pivotable locking member 290. The locking member 290 fits through aperture 292 in the left portion 286. The locking member can then be pivoted so that it cannot pass through the aperture. This action interlocks the left and right portions of the hasp together. Since the left and right portions are mounted on the left and right doors respectively, this action also locks the doors 214 and 216 of the enclosure in a closed position. A lock, such as a padlock, can also be placed through the aperture 294 of the locking member 290. This enables the enclosure to be securely locked and prevents unauthorized intrusion.

Figures 18A, 18B:
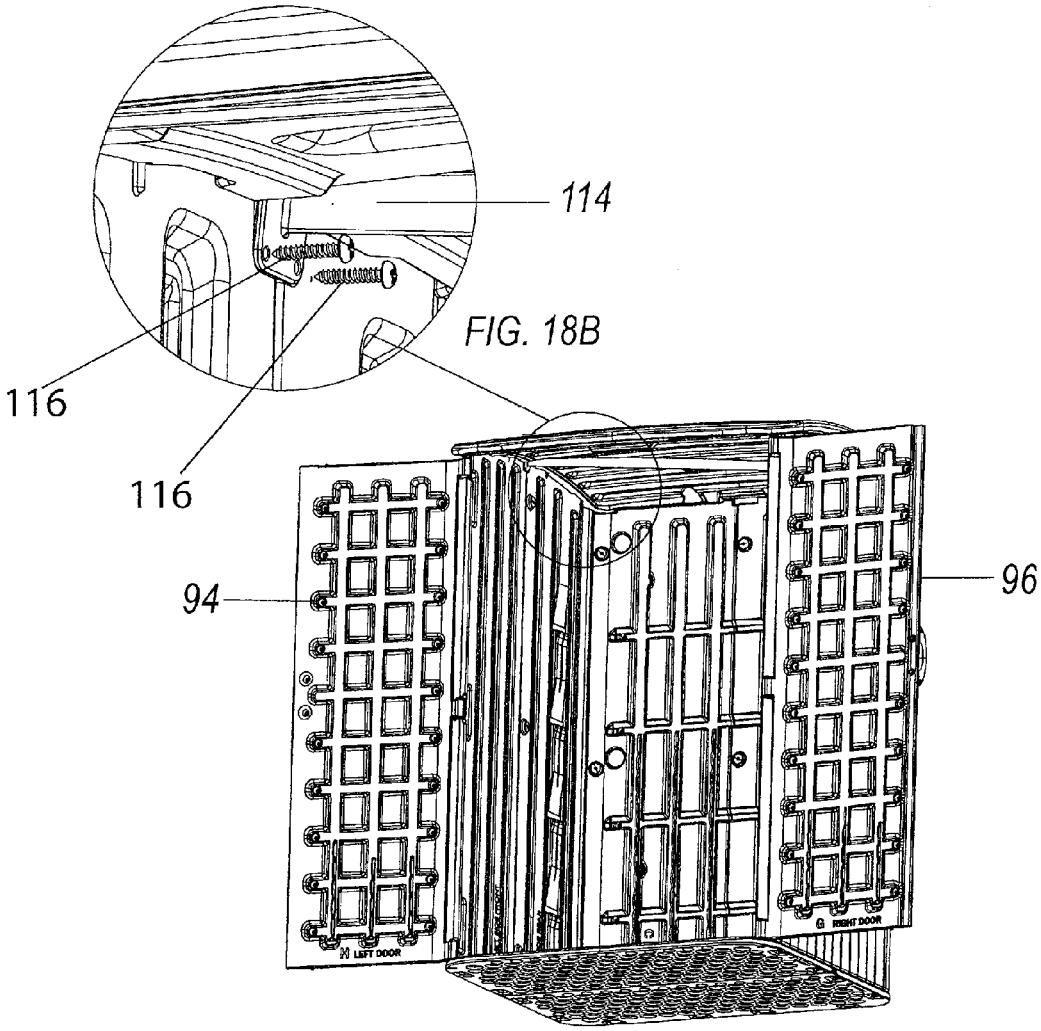
FIGS. 18A-B are partial perspective views of the embodiment shown in FIG. 1, illustrating assembly of a roof support assembled to the wall and roof assemblies.
Figures 19A, 19B:
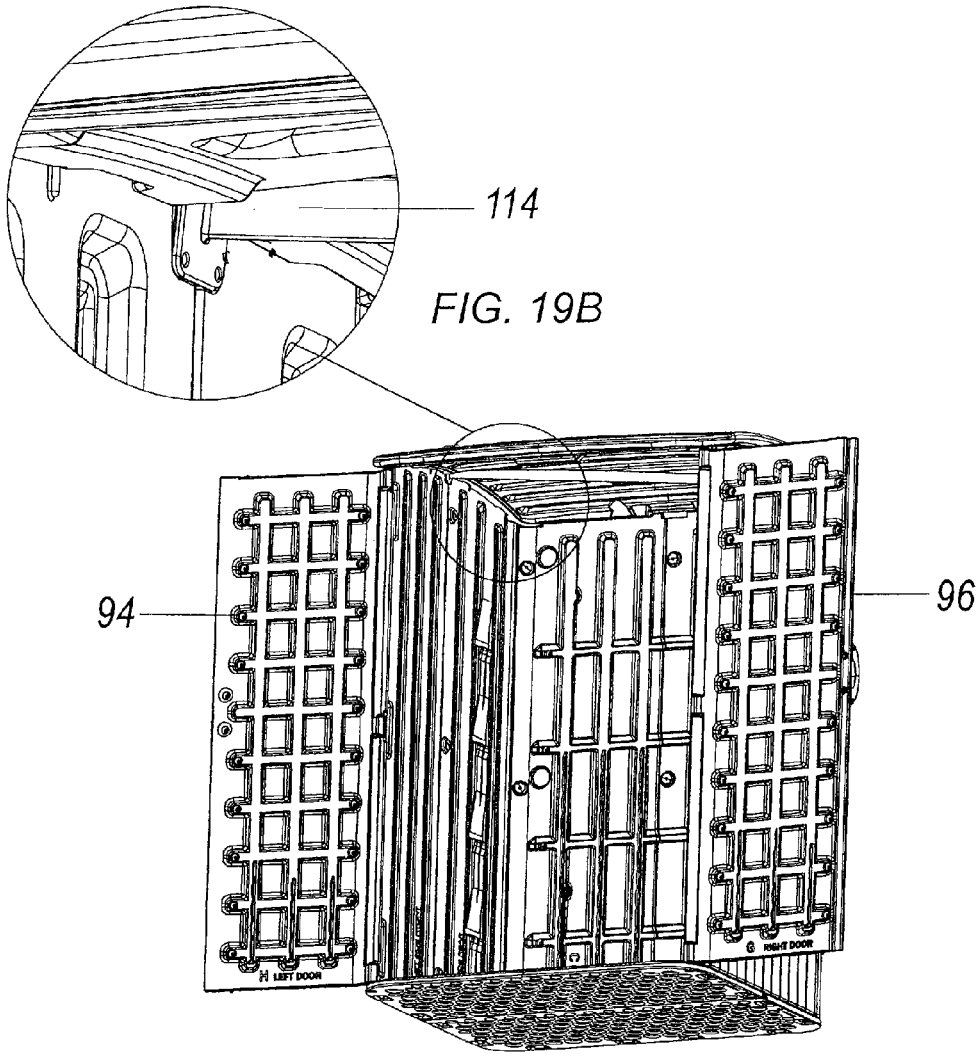
FIGS. 19A-B are partial perspective views of the embodiment shown in FIG. 1, illustrating further assembly of the roof support.
Figure 20B:
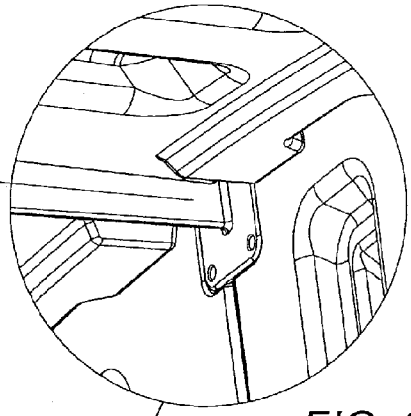
FIGS. 20A-B are partial perspective views of the assembled roof support.
Figure 20A:
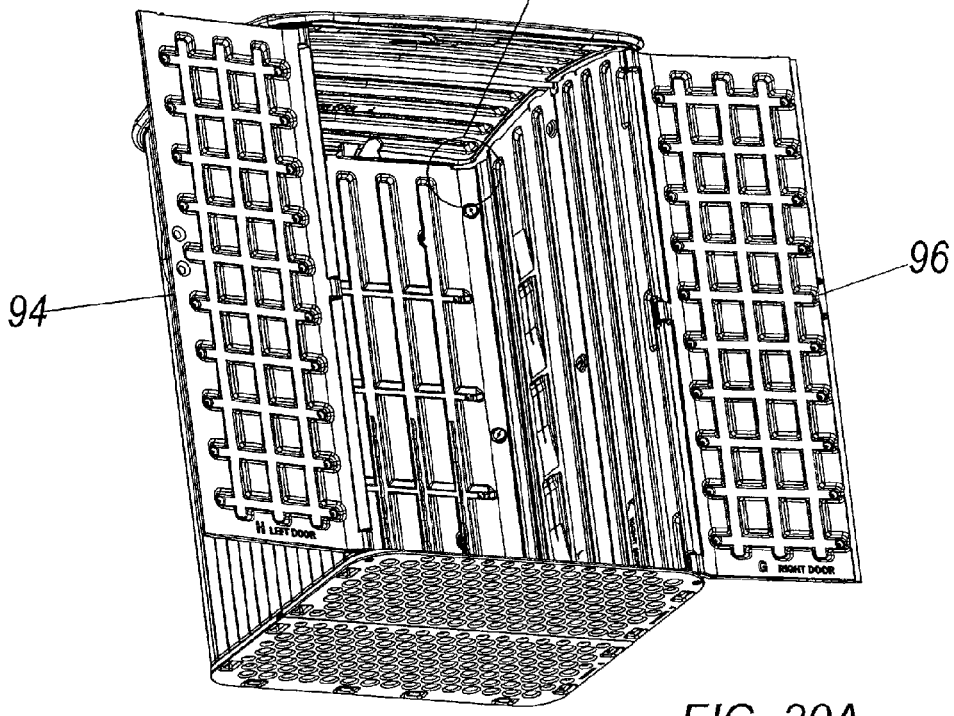
Figure 21:
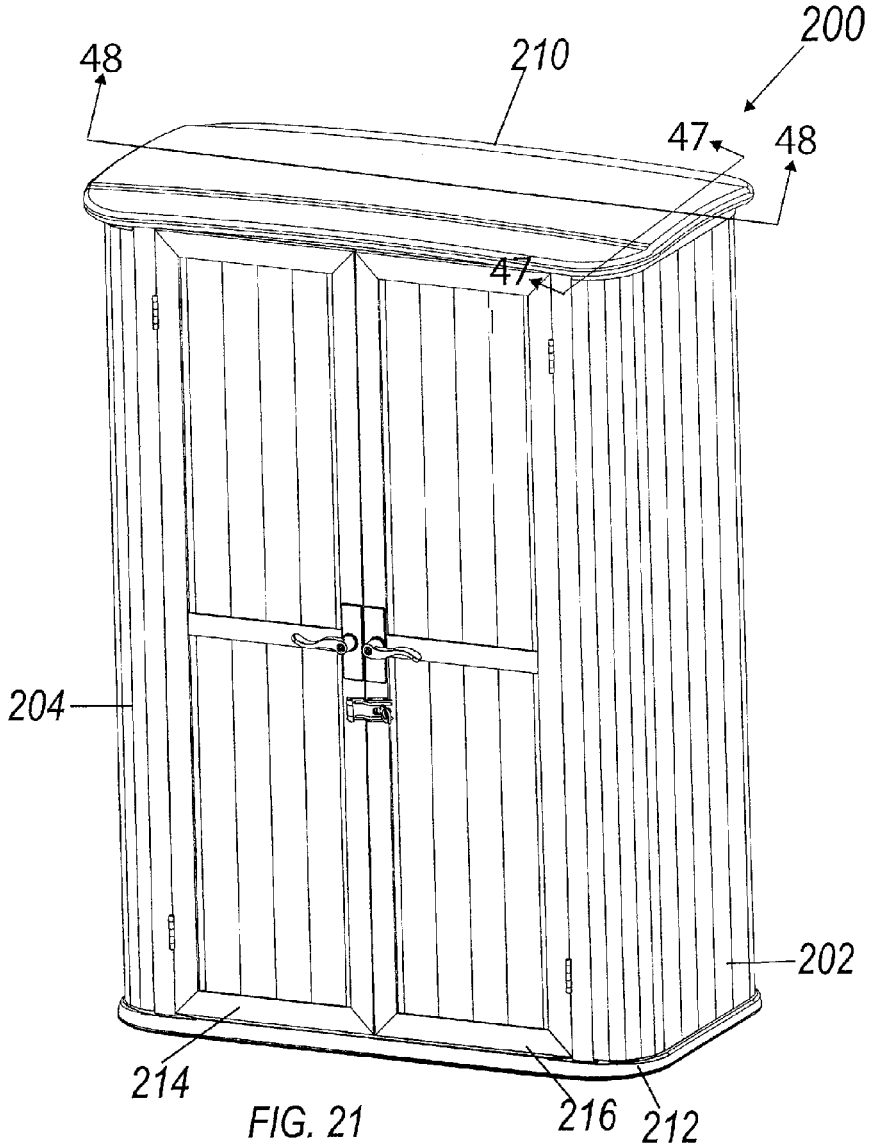
FIG. 21 is a front perspective view of a second embodiment of the present invention, illustrated with wooden side panels and common floor and roof assemblies.

FIGS. 18A-B illustrate a roof brace 114 secured to left side panel 20 with fasteners. The roof brace provides additional support for the roof panels. This additional support is useful to prevent collapse of the roof under heavy snow loads, etc. FIGS. 19A-B illustrate the roof brace 114 secured to right side panel 12 with fasteners. FIG. 18B illustrates the fasteners 116 used to secure the roof brace 114 to the side panels.

FIGS. 21-52, which are now referenced, show isometric and exploded views of a system or kit for the assembly of the present invention. FIGS. 21-51 utilize the floor panels, roof, top connectors, top connector members, floor connectors and floor connector members, found in FIGS. 1-20.

A utility enclosure or shed is generally illustrated at 200. The enclosure or shed 200 includes a right side panel 202, a left side panel 204, a back panel 206 (FIG. 22A), corner panels 208 (FIG. 22A), a roof panel 210, a floor panel 212 and front doors 214 and 216. The right side panel, left side panel, corner panels, back panels and doors are selected from one of wood and molded plastic. These panels are secured to each other in a manner which will be described hereinafter.

Figures 22A, 22B:
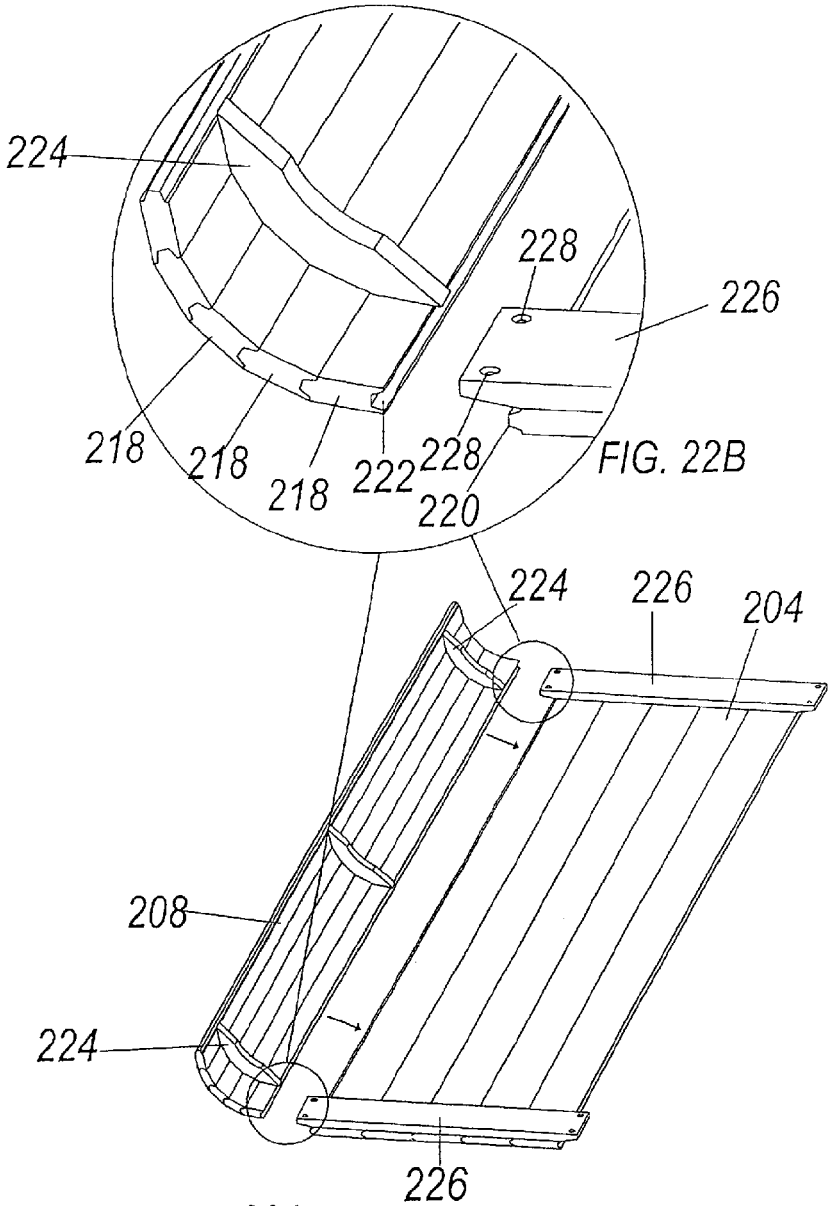
FIGS. 22A-B are partial perspective views of the embodiment shown in FIG. 21, illustrating the assembly of a wooden corner panel to a wooden side panel.

A corner panel 208 may be formed from a material selected from one of wood and molded plastic. When wood is selected to construct the corner panel 208, the corner panel 208 is formed from a plurality of wooden boards or siding 218 (FIG. 22B). Each board or siding 218 is provided with a "tongue side" 220 along one longitudinal edge and a "groove side" 222 along an opposite longitudinal edge. The tongue side of each board fits into the groove side of an adjacent board, as illustrated in FIG. 22B, to provide a water tight joint between the boards. This type of connection also provides a secure, structural connection between adjacent boards. A plurality of braces 224, are secured to an inner side of the corner panels. These braces 224 hold the boards or siding 218 together and provide structural support for the boards 218. While three braces 224 are illustrated, any number can be employed on each of the corner panels.

Figures 23A, 23B:
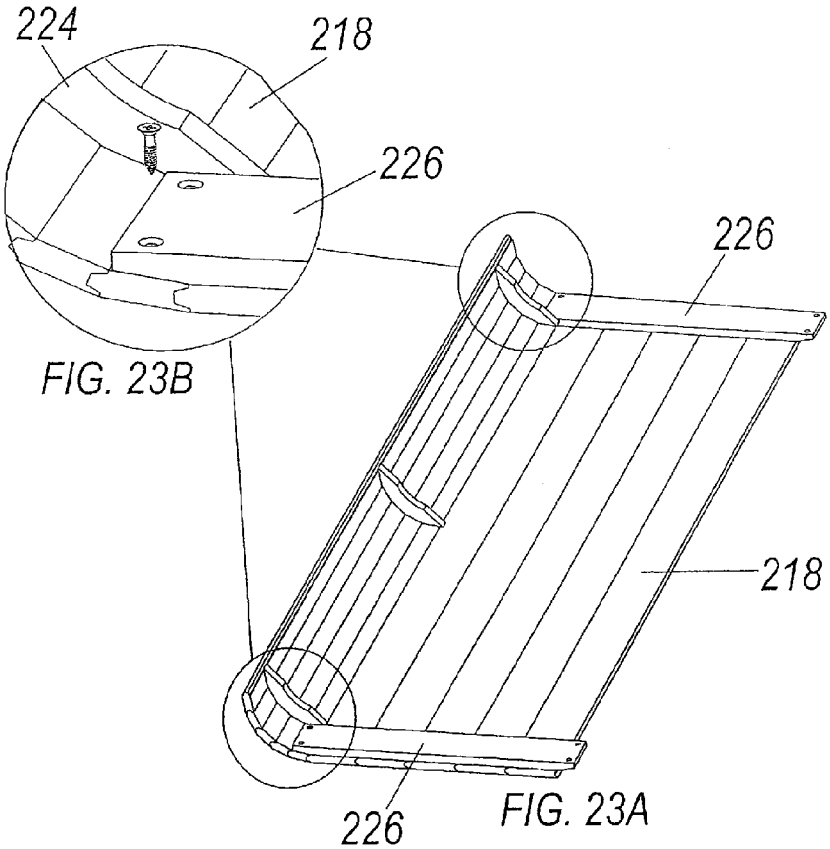
FIGS. 23A-B are partial perspective views further illustrating the assembly of a wooden corner panel to a wooden side panel.
Figure 25:
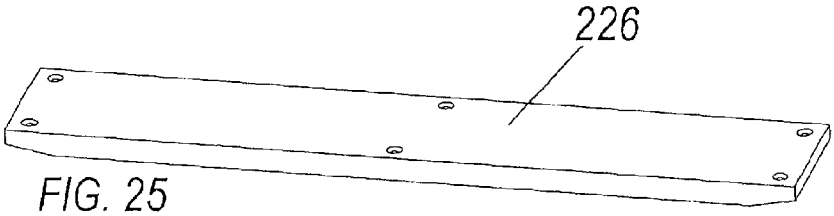
FIG. 25 is a perspective view of one of the internal braces illustrated in FIG. 24.

Support braces 226 are illustrated in FIGS. 22A and B; the support braces 226 are secured to the top and bottom portions of the side panel 204. Each of the boards or siding 218 on the side panel 204 are secured to the support braces. The ends of the support braces 226 are provided with apertures 228 (FIG. 22B). Fastening devices, such as screws, are set in to these apertures to secure the braces 226 of the side panel to the boards 218 of the corner panel (FIGS. 22B, 23A-B).

Figure 24:
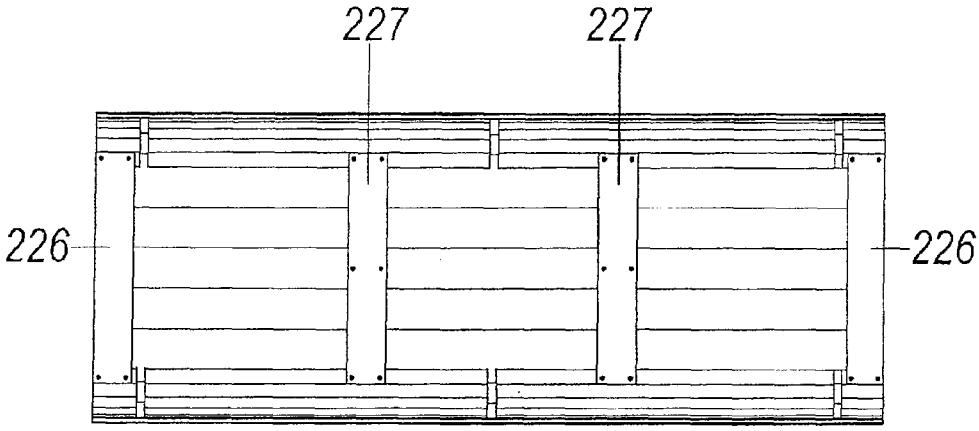
FIG. 24 is a partial view of the embodiment shown in FIG. 21, illustrating assembly of an internal brace to the inside surface of a side panel and two corner panels.

Additional support braces 227 are provided on the side panel between the top and bottom support braces (FIG. 24). These additional support braces provide structural strength and rigidity to the side panel. The additional support braces are secured to the corner panel 208 in the same manner that the top and bottom support braces were secured to the corner panel.

Figures 26A, 26B:
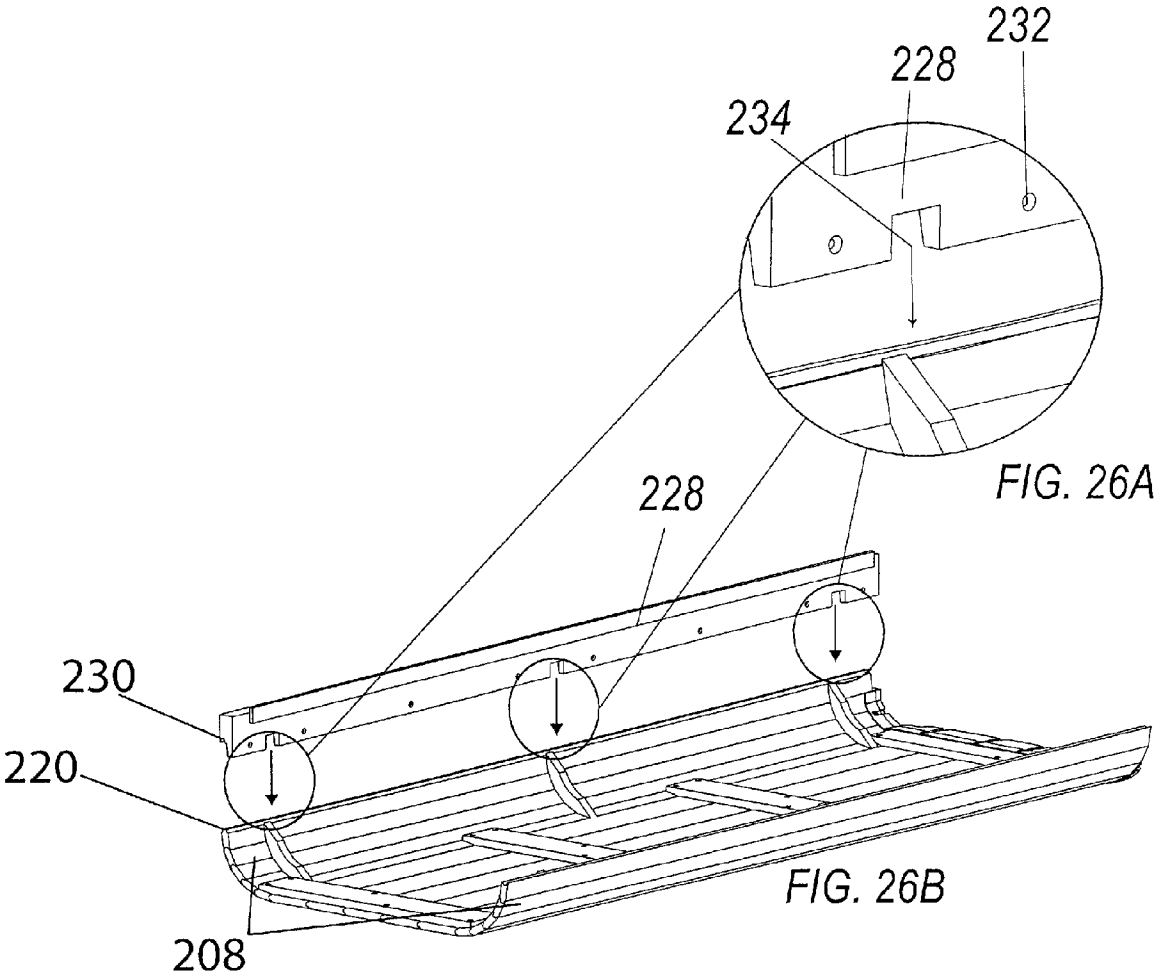
FIGS. 26A-B are partial perspective views of the embodiment shown in FIG. 21, illustrating assembly of a face frame to a corner panel.
Figures 27A, 27B:
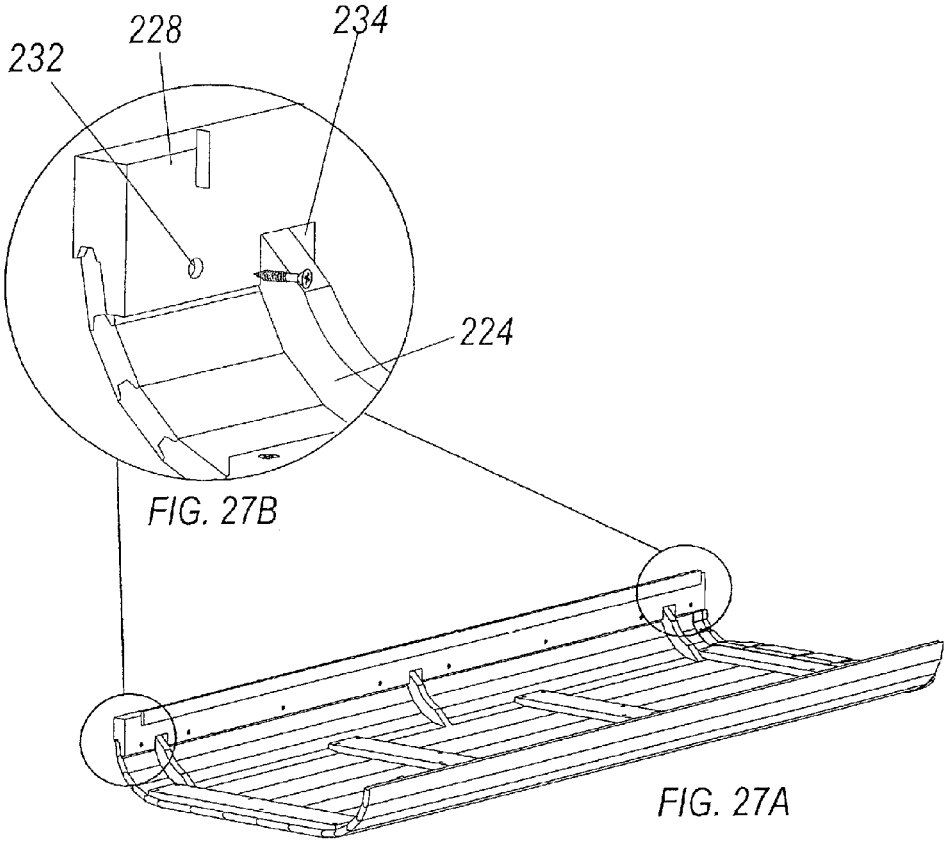
FIGS. 27A-B are partial perspective views of the embodiment shown in FIG. 21, further illustrating the attachment of the face frame to a corner panel.

A face frame member 228 is secured to a corner panel (FIGS. 26A-B). A longitudinal edge of the face frame 228 is provided with a "groove" 230 along the length thereof. The groove 230 is constructed and arranged to mate with the "tongue" 220 along the edge of a board 218 of the corner panel 208. Fasteners, such as screws, pass through apertures 232 on the face frame. These fasteners are used to secure the face frame 228 to the corner panel 208 (FIGS. 27A and B). Portions of the face frame are cut away at 234 to allow the face frame to fit around the braces 224 on the corner panel 208. A similar face frame member 229 (FIG. 45A) is secured to an opposite corner panel on the other side of the enclosure.

Figure 28:
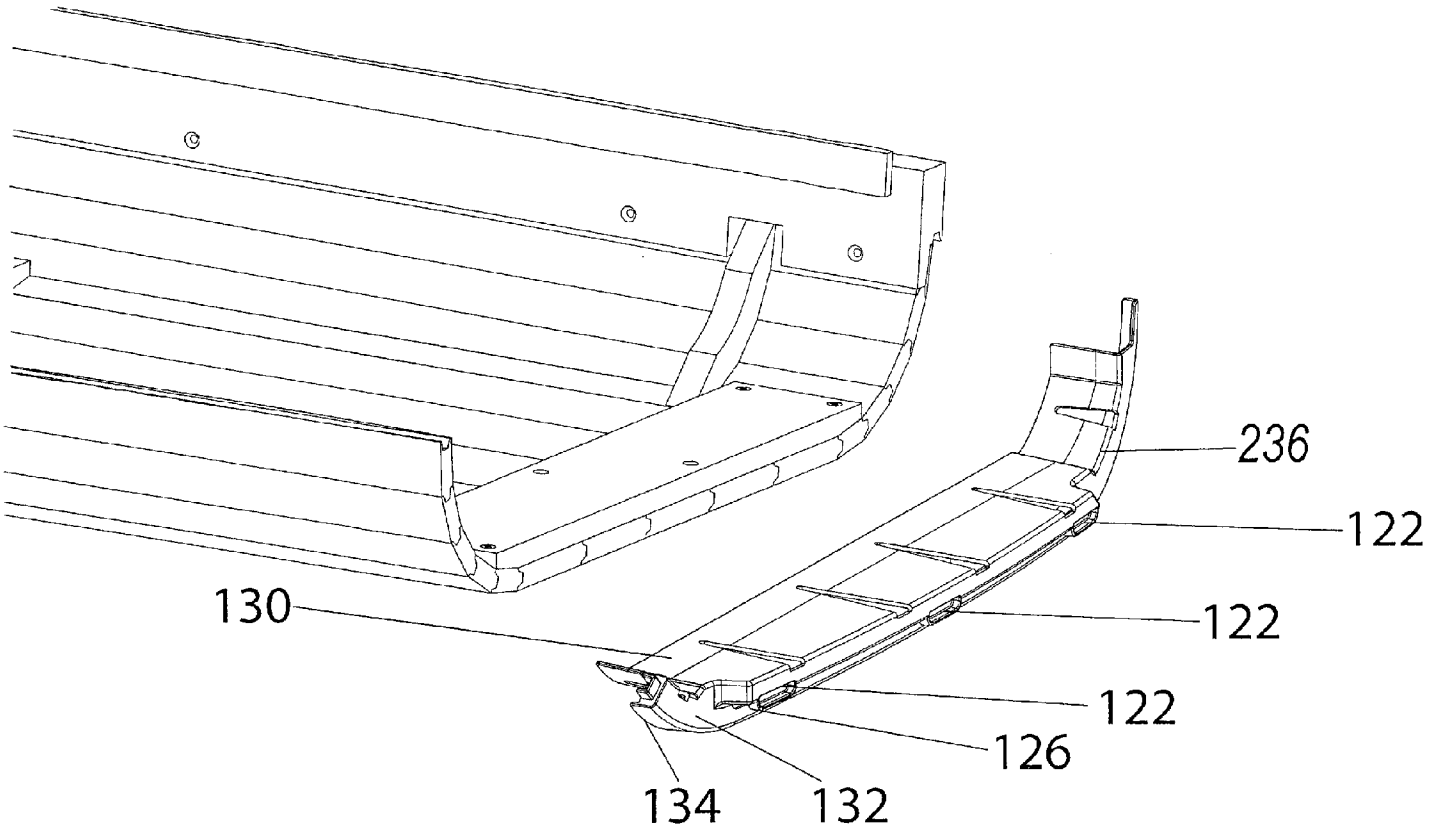
FIG. 28 is a partial perspective view of the embodiment shown in FIG. 21, illustrating assembly of a plastic top connector and a wooden side panel.
Figures 29A, 29B:
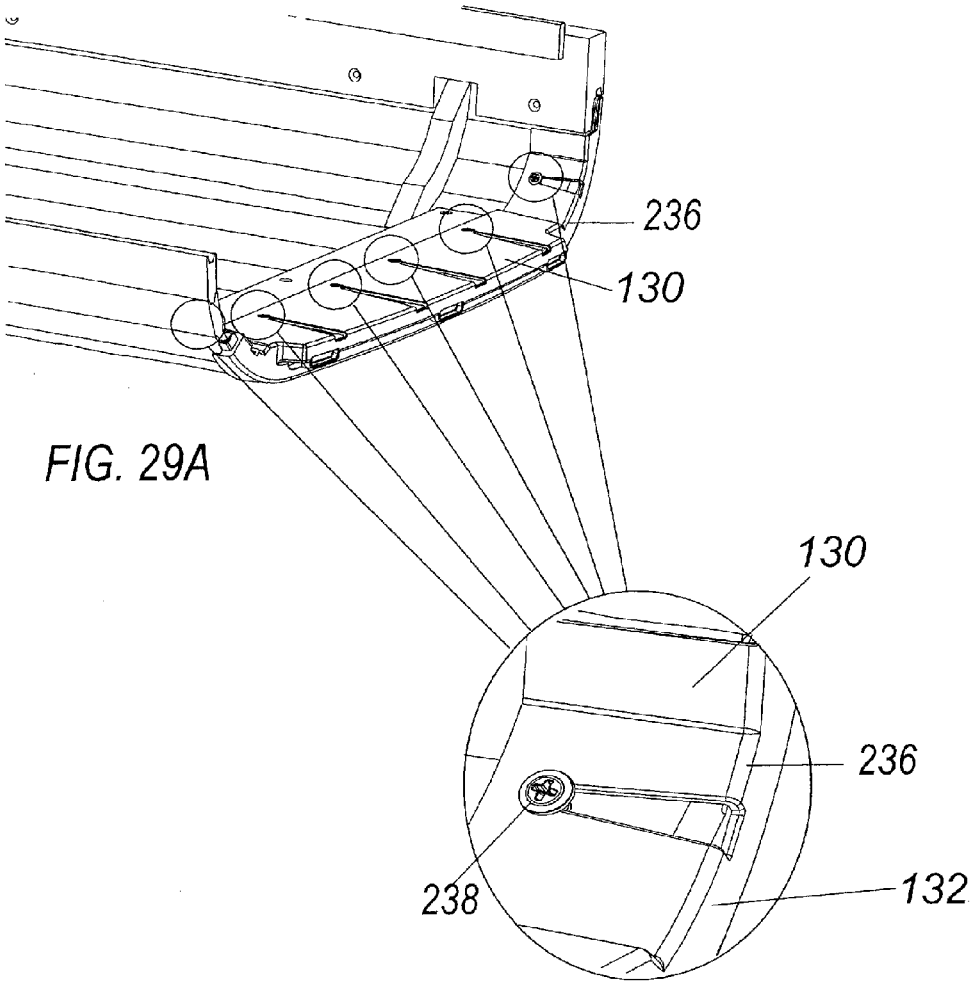
FIGS. 29A-B are partial perspective views of the assembled top connector and side panel of FIG. 28.

A top connector member 236 is secured along the top edge of a side panel and corner panel, as illustrated in FIGS. 28, 29A and 29B. The top connector member 236 includes a plurality of apertures 238 that receive fasteners, such as screws, that are passed through these apertures and secure the top connector member 236 to the side and corner panels (FIG. 29A). The top connector member 236 is made of a plastic or resin material. The top connector member is constructed and arranged to secure to the top edge of wood and molded plastic side panels.

Figures 33A, 33B:
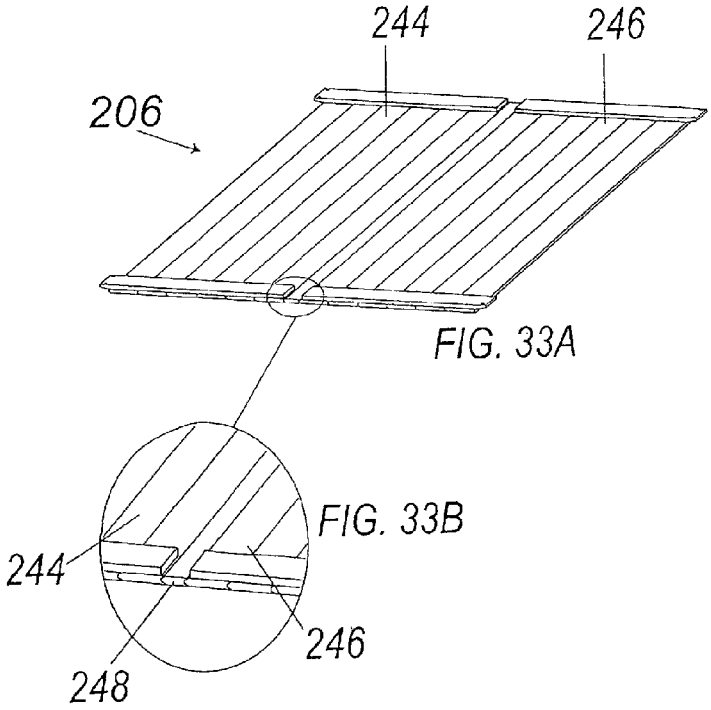
FIGS. 33A-B are partial perspective views of the filler board of FIG. 32 secured to the two back panels.

The back panel 206 of the enclosure includes a left back panel 244 and a right back panel 246 (FIG. 33A). This is mainly for manufacturing and shipping purposes. A filler board 248 is designed to be inserted between the left and right back panels, and provide a support to secure the left and right back panels together. A "groove" is provided along one longitudinal edge of filler board 248 and a "tongue" is provided along an opposite longitudinal edge of the filler board. These tongue and groove connections mate with comparable tongue and groove connections on boards 218 of the left and right back panels (FIG. 33B).

Figures 34, 35:
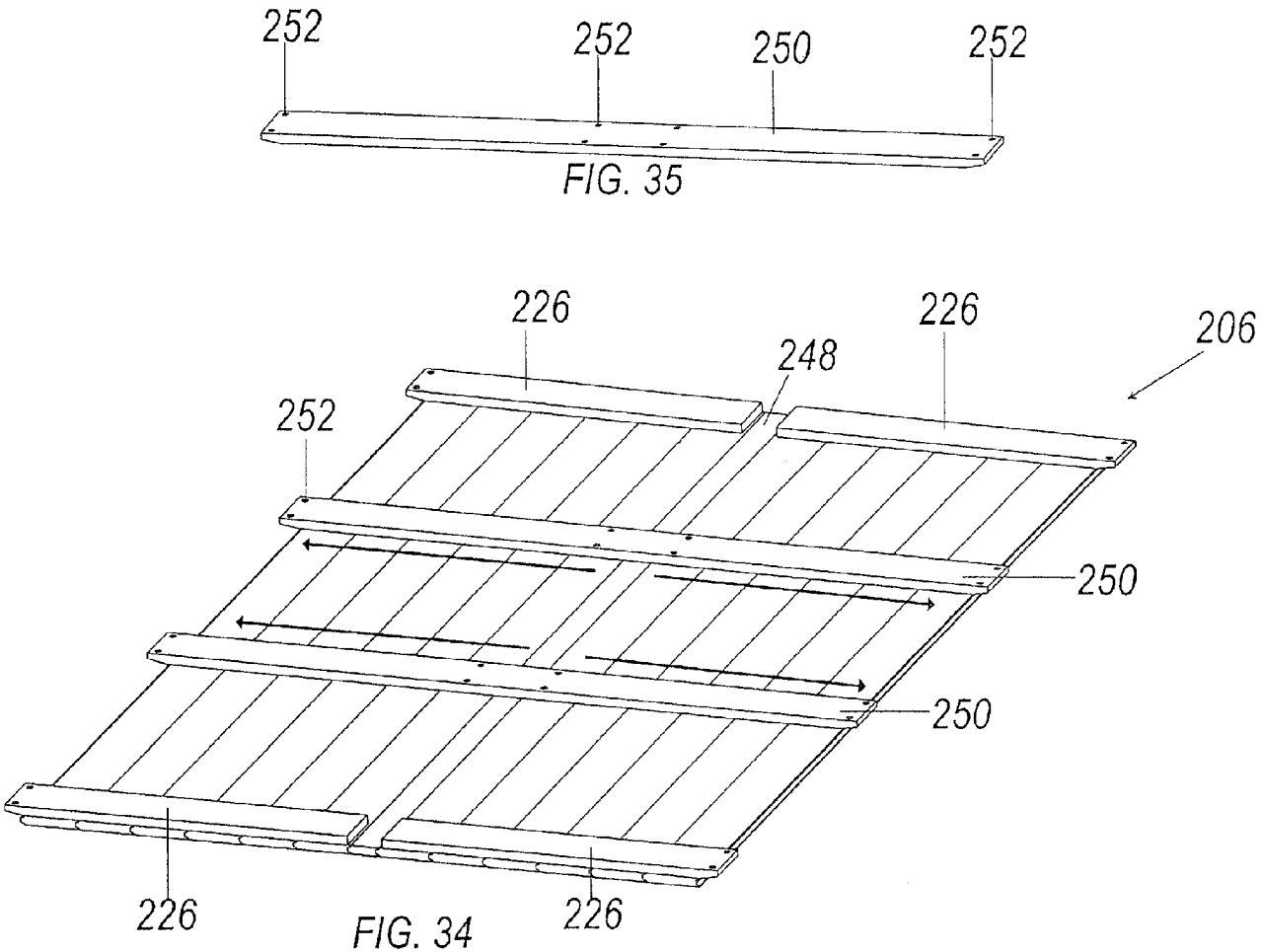
FIG. 34 is a partial perspective view, illustrating assembly of support braces to the inner surface of the back panels.
FIG. 35 is a perspective view of the support brace, securable to the inner surface of the back panels.
Figure 36:
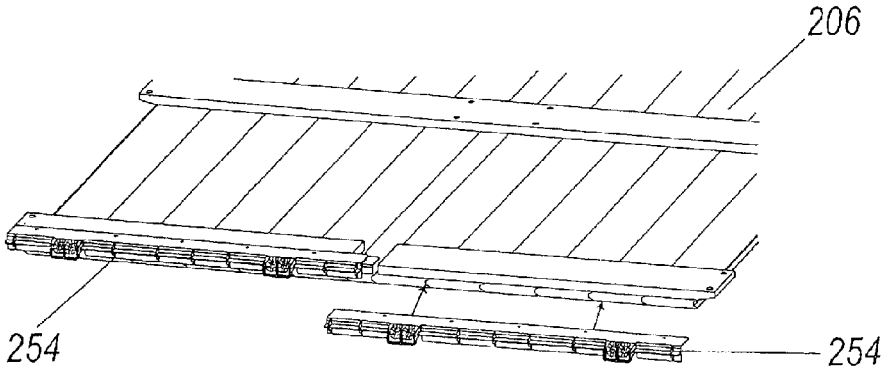
FIG. 36 is a partial perspective view of the embodiment shown in FIG. 21, illustrating a bottom connector being secured to one of the back panels.
Figure 37:
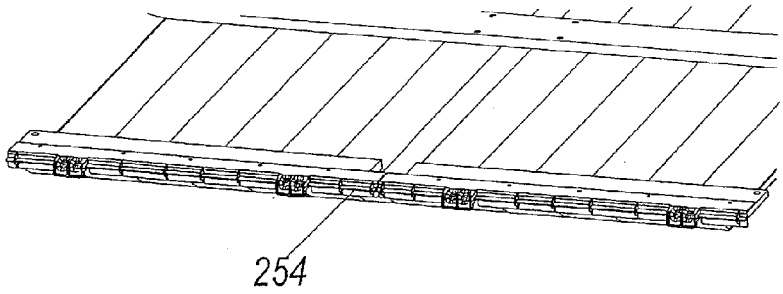
FIG. 37 is a partial perspective view of the bottom connectors of FIG. 36 secured to the back panels.
Figures 38A, 38B:
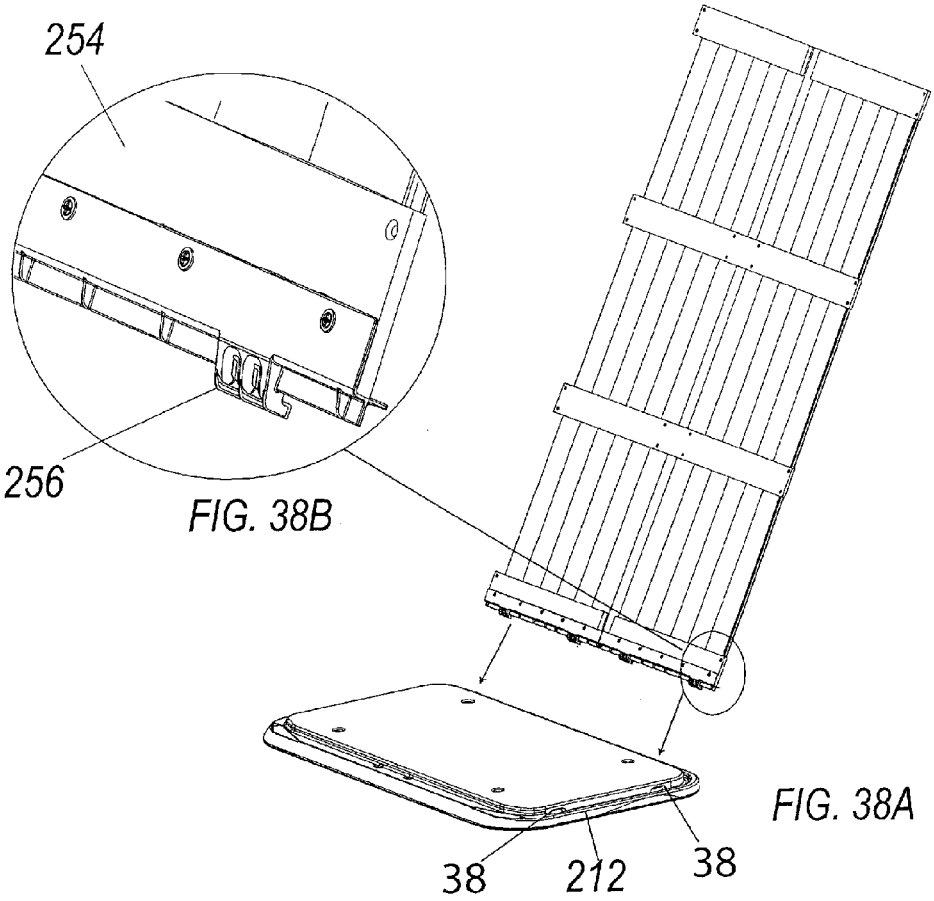
FIGS. 38A-B are partial perspective views of the back panel being secured to a floor panel.
Figure 39:
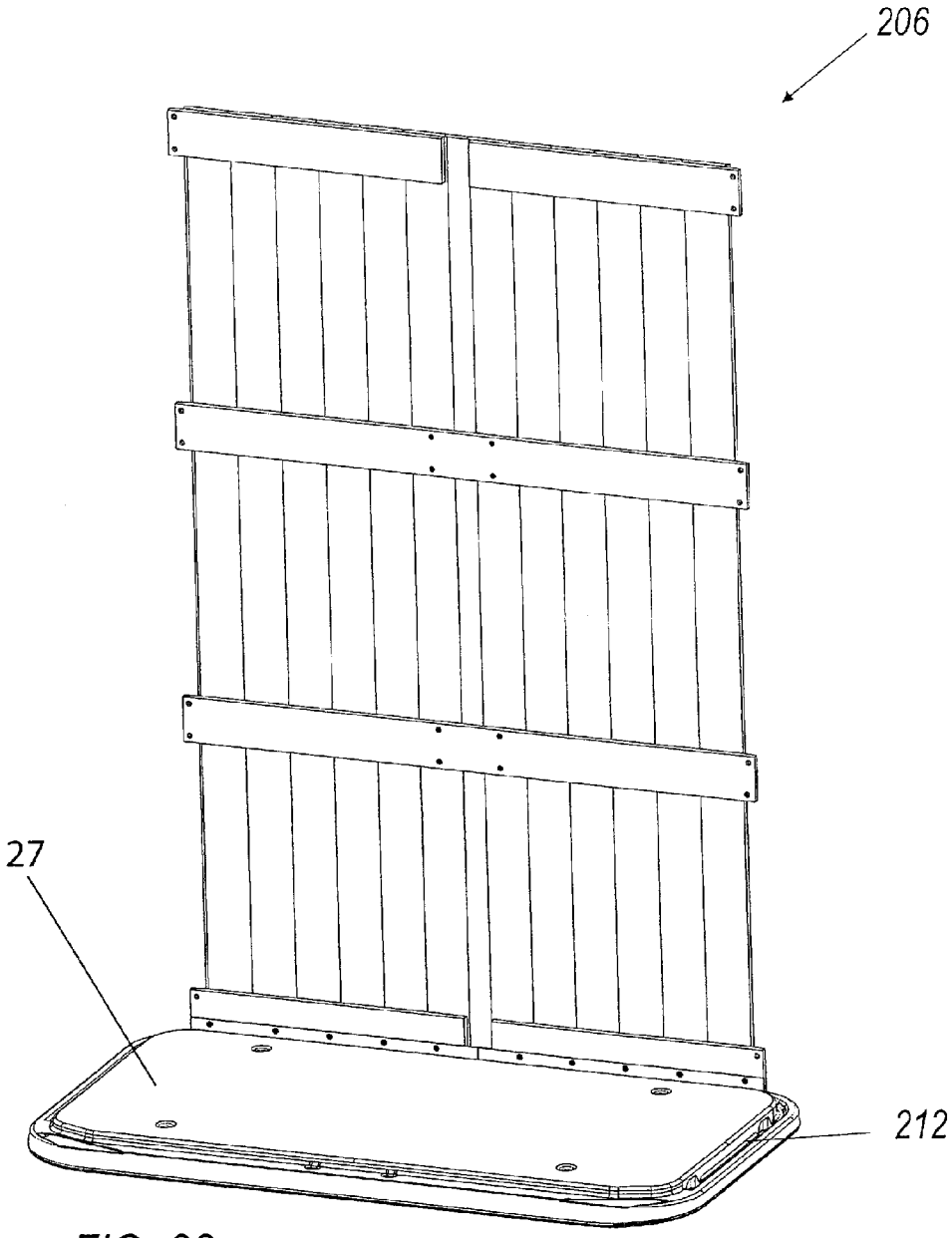
FIG. 39 is a partial perspective view of the back panel secured to a floor panel.
Figure 40:
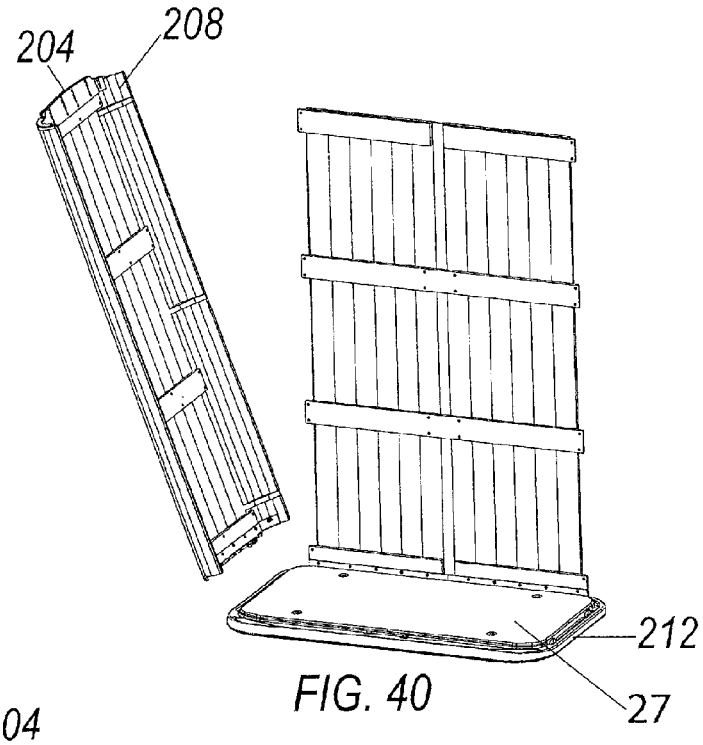
FIG. 40 is a partial perspective view of the embodiment shown in FIG. 21, illustrating side and corner panels being secured to a floor panel.
Figure 41:
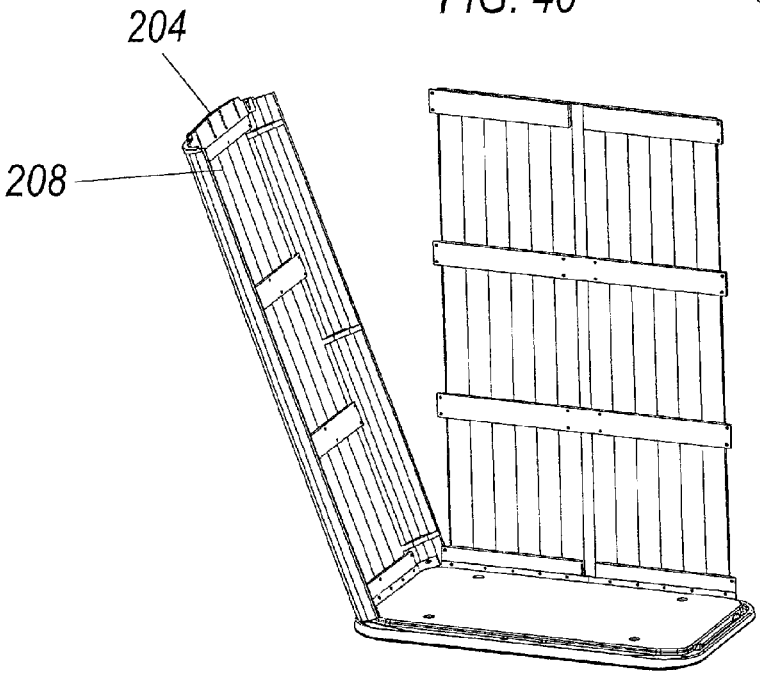
FIG. 41 is a partial perspective view of the embodiment shown in FIG. 21, illustrating side and corner panels being secured to a floor panel.
Figure 42:
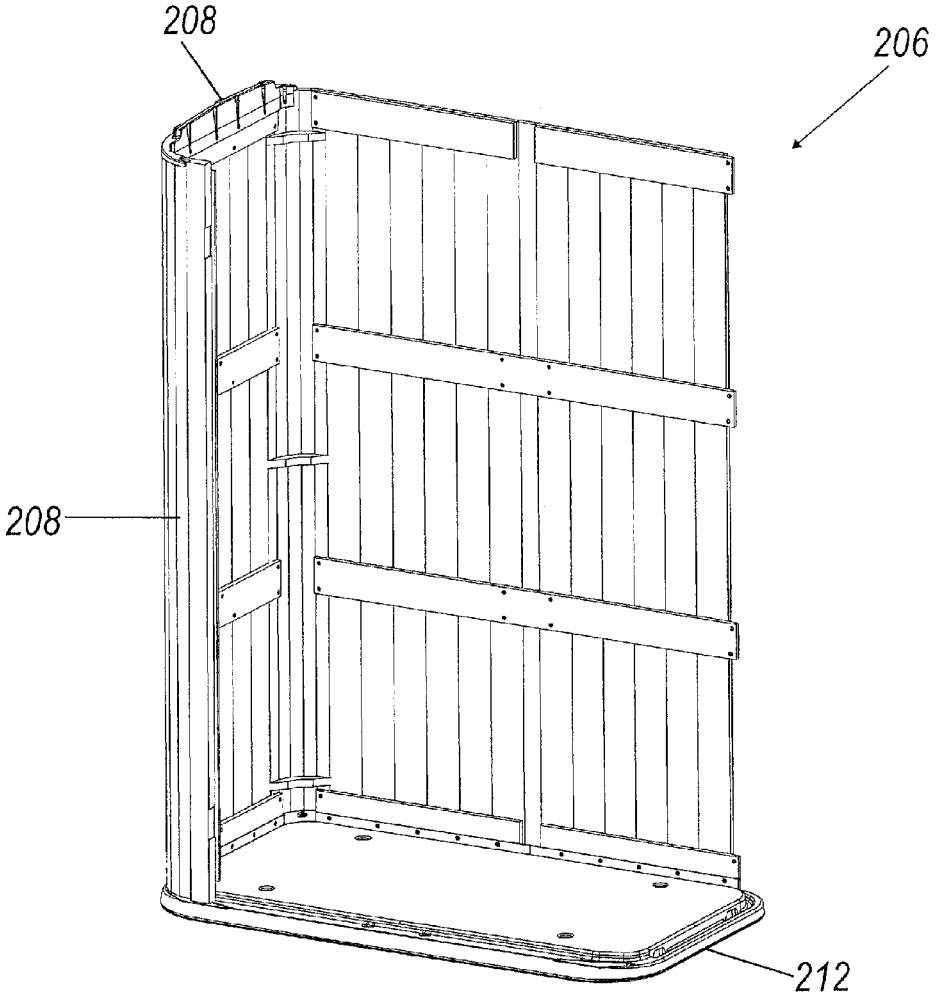
FIG. 42 is a perspective view of the side, corner, and back panels secured to the floor panel.
Figure 43:
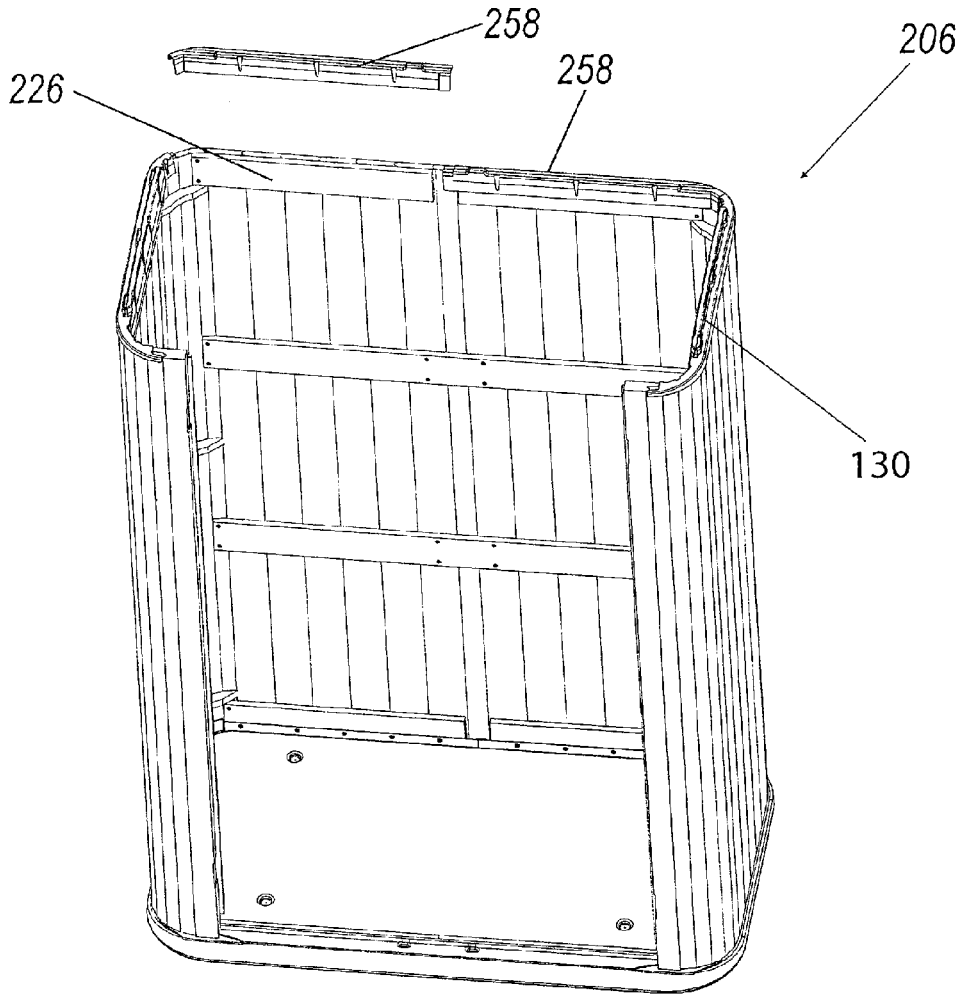
FIG. 43 is a partial perspective view of the embodiment shown in FIG. 21, illustrating assembly of a top connector to the assembled wall and floor panels.
Figure 44A:
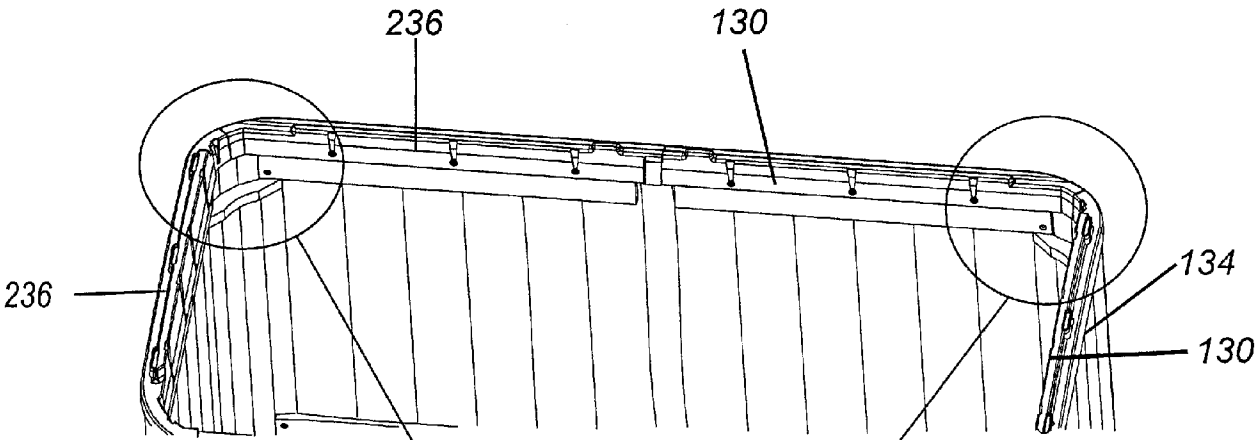
FIGS. 44A-B are partial perspective views, illustrating the top connectors assembled to the back and side panels.
Figure 44B:
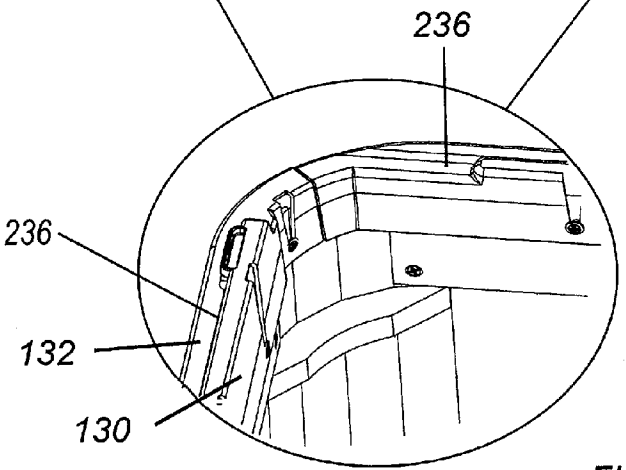

FIG. 34, the left and right back panels are provided with support braces 226 along a top and bottom edge thereof. These support braces hold the boards 218 together during shipping, prior to assembly and afterwards. Additional support braces 250 extend across the widths of the left and right back panels. These additional braces 250, together with the filler board 248, securely hold the left and right back panels to each other and thus form the back panel 206. The support braces 250 are provided with apertures 252. Fasteners, such as screws, are passed through these apertures and secure the support braces 250 to the back panels and the corner panels.

Figure 30:
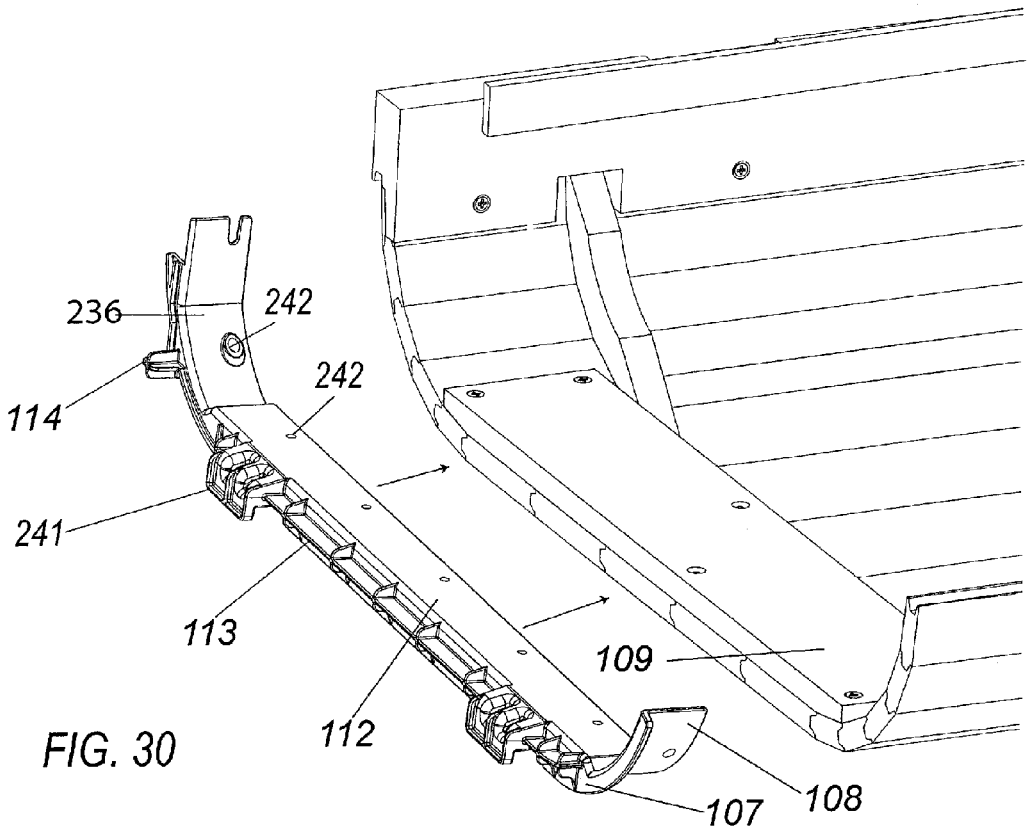
FIG. 30 is a partial perspective view of the embodiment shown in FIG. 21, illustrating assembly of a plastic bottom connector and a wooden side panel.
Figure 31:
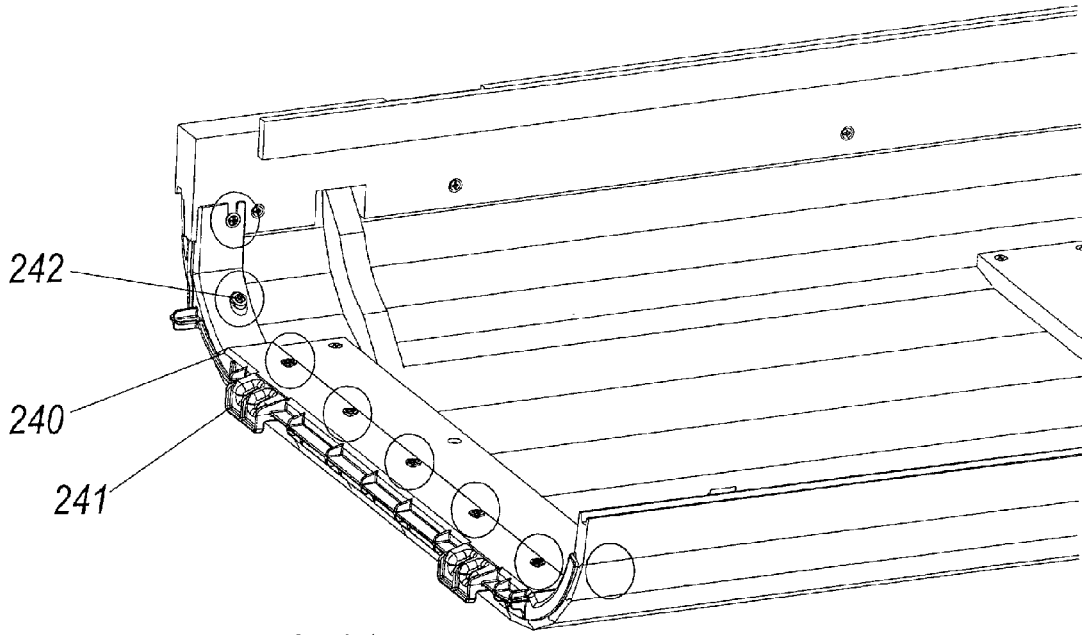
FIG. 31 is a partial perspective view of the assembled bottom connector secured to the side panel of FIG. 30.
Figure 32:
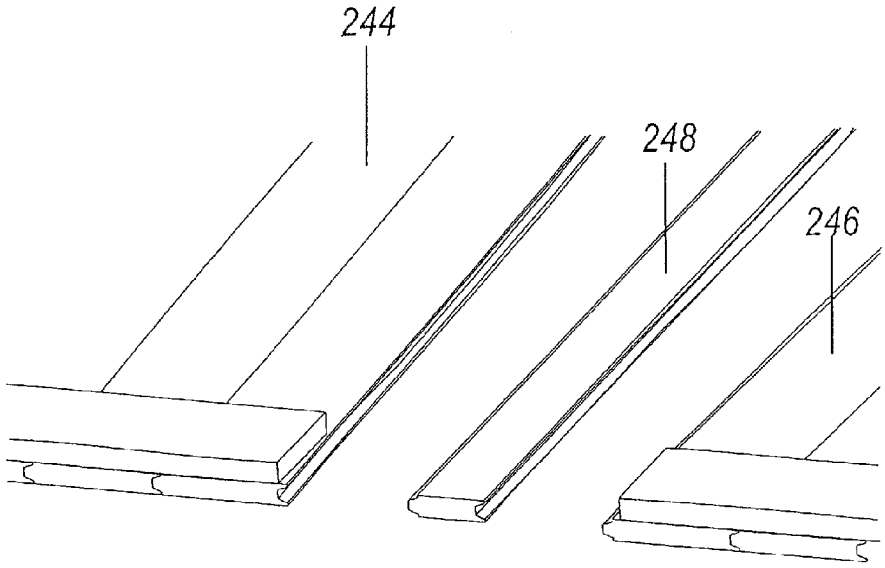
FIG. 32 is a partial perspective view of the embodiment shown in FIG. 21, illustrating assembly of a filler board between two back panels.

Bottom connectors 236 are secured along the bottom edge of the back panel 206. As illustrated in FIG. 30, there are two bottom connectors secured to the bottom edge of panel 206. While two bottom connectors are illustrated, any number of connectors can be employed. The bottom connectors 236 are made of a plastic or resin material.

Figures 45A, 45B:
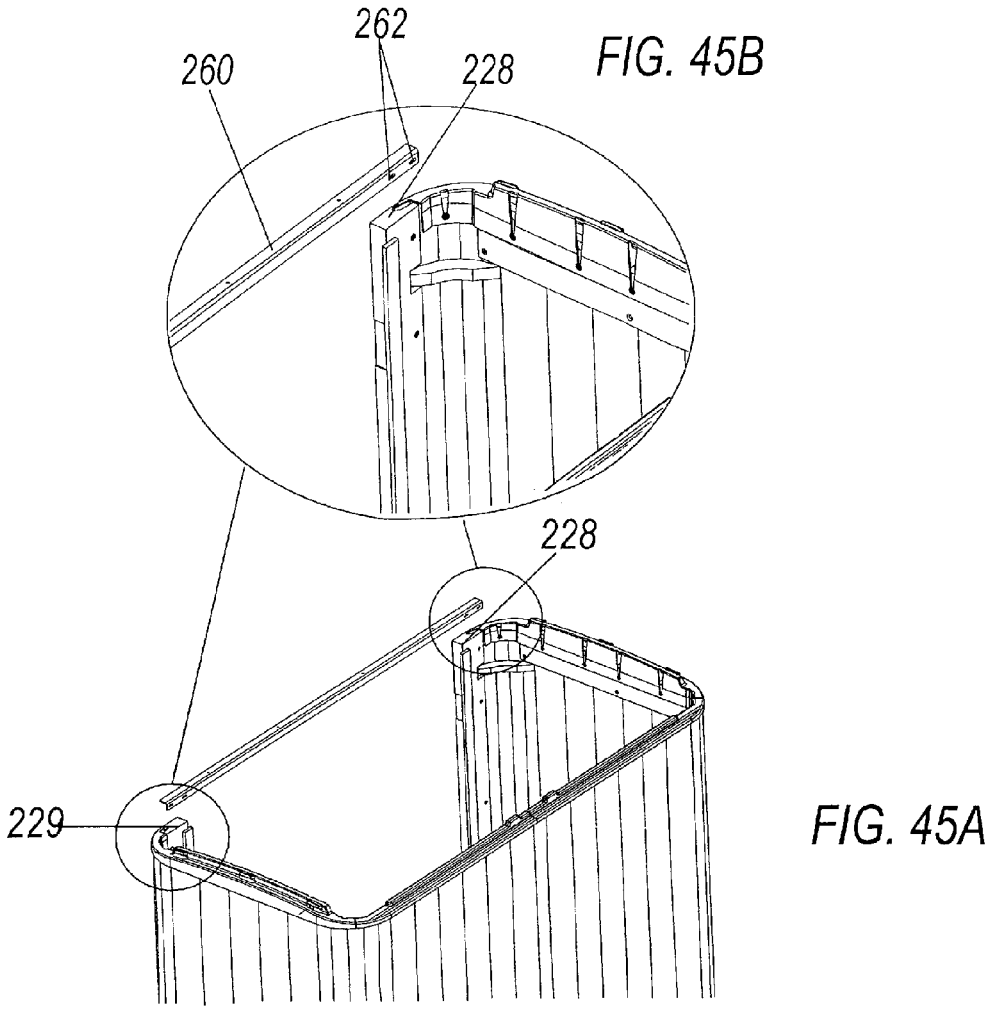
FIGS. 45A-B are partial perspective views of the embodiment shown in FIG. 21, illustrating a door header being installed between the side panels.

Referring to FIGS. 45A and B, the header member of the present invention is illustrated. The header member 260 is secured to the left and right face frame members 228 and 229. Apertures 262 are provided on the header which permits fasteners, such as screws, to secure the header to the face frame members. In a preferred embodiment the header 260 is made from metal. Other materials can also be used for the header.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A connector system for connecting panels together to form an enclosure comprising;

a floor panel for enclosing the bottom portion of said enclosure, said floor panel including a first portion of a floor connector, said first portion of said floor connector being constructed and arranged to cooperate with a second portion of a floor connector to secure a wall assembly to said floor panel in a perpendicular arrangement without fasteners, said first portion of said floor connector including at least one recessed socket for each panel, said at least one recessed socket including an undercut, whereby said second portion of said floor connector cooperates with said at least one socket and said undercut to secure said panels together in a substantially perpendicular arrangement with respect to each other, said second portion of said floor connector including at least one tab member extending downwardly from a bottom surface of said second portion of said floor connector, said tab having at least one bend for cooperating with said undercut in said at least one socket, said bend requiring said tab to enter said socket at an angle other than perpendicular and thereafter be rotated to a perpendicular position to interlock said first and said second portions of said floor connector, said second portion of said floor connector constructed and arranged for connection to a lower portion of a wall assembly;

wherein said second portion of said floor connector includes a horizontal wall portion, said horizontal wall portion securable to the lower portion of the wall assembly, a rear wall assembly having a top portion and a bottom portion, said bottom portion including said second portion of said floor connector secured thereto, said second portion of said floor connector being constructed and arranged to cooperate with said first portion of said floor connector for securing said rear wall assembly to said floor panel without fasteners, said top portion of said rear wall assembly including a first portion of a roof connector secured thereto, said first portion of said roof connector being constructed and arranged to cooperate with a second portion of a roof connector for securing said rear wall assembly to a roof panel;

a pair of side wall assemblies each having a top portion and a bottom portion, each said bottom portion including said second portion of said floor connector secured thereto, said second portion of said floor connector being constructed and arranged to cooperate with said first portion of said floor connector for securing said pair of side wall assemblies to said floor panel without fasteners, each said top portion of said pair of side wall assemblies including said first portion of said roof connector secured thereto, said first portion of said roof connector being constructed and arranged to cooperate with said second portion of said roof connector for securing said pair of side wall assemblies to a roof panel;

said roof panel for enclosing the top portion of said enclosure, said roof panel including a second portion of said roof connector for securing said roof panel to said wall assemblies;

at least one door member, said at least one door member secured along one edge to at least one of said pair of side wall assemblies with a hinge.

2. The connector system of claim 1 wherein said floor panel includes a plurality of said sockets extending along at least a rear edge and two side edges of said floor panel.

3. The connector system of claim 2 wherein said first portion of said floor connector includes a groove extending around the perimeter of said rear edge and said two side edges of said floor panel.

4. The connector system of claim 3 wherein said groove extends through said plurality of sockets.

5. The connector system of claim 1 wherein said at least one tab is substantially L-shaped.

6. The connector system of claim 1 wherein said second portion of said floor connector includes a plurality of said tabs in a spaced apart but substantially linear arrangement.

7. The connector system of claim 6 wherein said second portion of said floor connector includes a key member extending along said second portion of said floor connector.

8. The connector system of claim 7 wherein said second portion of said floor connector includes at least one pin member extending downwardly therefrom, said pin member being constructed and arranged to cooperate with said floor panel to locate said second portion of said floor connector with respect to said first portion of said floor connector.

9. The connector system of claim 1 wherein said second portion of said floor connector includes a depending flange member, said depending flange member constructed and arranged to extend adjacent to a substantially vertical surface of said wall assemblies for securement thereto.

10. The connector system of claim 1 wherein said second portion of said floor connector and said wall assemblies are constructed from dissimilar materials.

11. The connector system of claim 1 wherein said second portion of said floor connector is integrally formed to a bottom portion of said wall assemblies.

12. The connector system of claim 1 wherein said first portion of said roof connector includes a flange portion, a portion of said flange extending upward beyond a top surface of said wall assemblies, at least one key member extending outwardly from said vertical flange, said at least one key member having a bearing surface on a bottom portion thereof.

13. The connector system of claim 12 wherein said flange portion that extends upward beyond said top surface of said wall assemblies includes a plurality of said key members extending outwardly from said vertical flange.

14. The connector system of claim 13 wherein said flange includes a second flange extending outwardly therefrom, said second flange constructed and arranged to fit adjacent to said bottom surface of said wall assemblies.

15. The connector system of claim 14 wherein said second flange includes a third flange depending therefrom, whereby said first flange, said second flange and said third flange form a U-shaped trough, said trough sized to fit around an inner, an outer and a bottom surface of wall assemblies.

16. The connector system of claim 12 wherein said first portion of said roof connector is integrally formed to said top portion of a wall assemblies.

17. The connector system of claim 12 wherein said second portion of said roof connector includes a bayonet slot formed therein, said at least one bayonet slot including a receiving portion sized to accept said key member and a ramp portion extending from said receiving portion, said ramp portion arranged to cooperate with said bearing surface during linear translation of said roof panel to cause said roof panel to pull tightly against a top surface of said wall assemblies.

18. The connector system of claim 17 wherein said roof panel includes at least one stop member constructed and arranged to cooperate with an inner surface of said wall assemblies once said roof panel has been translated a predetermined distance to prevent said roof panel from moving in an opposite direction.

19. The connector system of claim 17 wherein said roof panel includes a plurality of said bayonet slots.

20. The connector system of claim 1 including a plurality of floor panels, said plurality of floor panels including an overlapping and interlocking connection at each junction of said panels.

21. The connector system of claim 1 including a plurality of roof panels, said plurality of roof panels including an overlapping and interlocking connection at each junction of said panels.

22. A connector system for connecting panels together to form an enclosure comprising;

a floor panel for enclosing the bottom portion of said enclosure, said floor panel including a first portion of a floor connector, said first portion of said floor connector being constructed and arranged to cooperate with a second portion of a floor connector to secure a wall assembly to said floor panel in a perpendicular arrangement without fasteners, said first portion of said floor connector includes at least one recessed socket for each panel, said at least one recessed socket including an undercut, whereby said second portion of said floor connector cooperates with said at least one socket and said undercut to secure said panels together in a substantially perpendicular arrangement with respect to each other, said second portion of said floor connector includes at least one tab member extending downwardly from a bottom surface of said second portion of said floor connector, said tab having at least one bend for cooperating with said undercut in said at least one socket, said bend requiring said tab to enter said socket at an angle other than perpendicular and thereafter be rotated to a perpendicular position to interlock said first and said second portions of said floor connector, said second portion of said floor connector includes a plurality of said tabs in a spaced apart but substantially linear arrangement, said second portion of said floor connector includes a key member extending along said second portion of said floor connector, said second portion of said floor connector includes at least one pin member extending downwardly therefrom, said pin member being constructed and arranged to cooperate with said floor panel to locate said second portion of said floor connector with respect to said first portion of said floor connector;

a rear wall assembly having a top portion and a bottom portion, said bottom portion including said second portion of said floor connector secured thereto, said second portion of said floor connector being constructed and arranged to cooperate with said first portion of said floor connector for securing said rear wall assembly to said floor panel without fasteners, said top portion of said rear wall assembly including a first portion of a roof connector secured thereto, said first portion of said roof connector being constructed and arranged to cooperate with a second portion of a roof connector for securing said rear wall assembly to a roof panel;

a pair of side wall assemblies each having a top portion and a bottom portion, each said bottom portion including said second portion of said floor connector secured thereto, said second portion of said floor connector being constructed and arranged to cooperate with said first portion of said floor connector for securing said pair of side wall assemblies to said floor panel without fasteners, each said top portion of said pair of side wall assemblies including said first portion of said roof connector secured thereto, said first portion of said roof connector being constructed and arranged to cooperate with said second portion of said roof connector for securing said pair of side wall assemblies to a roof panel;

said roof panel for enclosing the top portion of said enclosure, said roof panel including said second portion of said roof connector for securing said roof panel to said wall assemblies;

at least one door member, said at least one door member secured along one edge to at least one of said pair of side wall assemblies with a hinge.

23. A connector system for connecting panels together to form an enclosure comprising;

a floor panel for enclosing the bottom portion of said enclosure, said floor panel including a first portion of a floor connector, said first portion of said floor connector being constructed and arranged to cooperate with a second portion of a floor connector to secure a wall assembly to said floor panel in a perpendicular arrangement without fasteners;

a rear wall assembly having a top portion and a bottom portion, said bottom portion including said second portion of said floor connector secured thereto, said second portion of said floor connector being constructed and arranged to cooperate with said first portion of said floor connector for securing said rear wall assembly to said floor panel without fasteners, said top portion of said rear wall assembly including a first portion of a roof connector secured thereto, said first portion of said roof connector being constructed and arranged to cooperate with a second portion of a roof connector for securing said rear wall assembly to a roof panel;

a pair of side wall assemblies each having a top portion and a bottom portion, each said bottom portion including said second portion of said floor connector secured thereto, said second portion of said floor connector being constructed and arranged to cooperate with said first portion of said floor connector for securing said pair of side wall assemblies to said floor panel without fasteners, each said top portion of said pair of side wall assemblies including said first portion of said roof connector secured thereto, said first portion of said roof connector being constructed and arranged to cooperate with said second portion of said roof connector for securing said pair of side wall assemblies to a roof panel;

said roof panel for enclosing the top portion of said enclosure, said roof panel including said second portion of said roof connector for securing said roof panel to said wall assemblies, said first portion of said roof connector includes a flange portion, a portion of said flange extending upward beyond a top surface of said wall assemblies, at least one key member extending outwardly from said vertical flange, said at least one key member having a bearing surface on a bottom portion thereof, said flange portion that extends upward beyond a top surface of said wall assemblies includes a plurality of said key members extending outwardly from said vertical flange, said flange includes a second flange extending outwardly therefrom, said second flange constructed and arranged to fit adjacent to said bottom surface of said wall assemblies, said second flange includes a third flange depending therefrom, whereby said first flange, said second flange and said third flange form a U-shaped trough, said trough sized to fit around an inner, an outer and a bottom surface of said wall assemblies;

at least one door member, said at least one door member secured along one edge to at least one of said pair of side wall assemblies with a hinge.

24. The connector system of claim 23 wherein said second portion of said roof connector includes a bayonet slot formed therein, said at least one bayonet slot including a receiving portion sized to accept said key member and a ramp portion extending from said receiving portion, said ramp portion arranged to cooperate with said bearing surface during linear translation of said roof panel to cause said roof panel to pull tightly against a top surface of said wall assemblies.

25. The connector system of claim 23 wherein said roof panel includes at least one stop member constructed and arranged to cooperate with an inner surface of said wall assemblies once said roof panel has been translated a predetermined distance to prevent said roof panel from moving in an opposite direction.

26. The connector system of claim 23 wherein said roof panel includes a plurality of said bayonet slots.

* * * * *